US009868018B2

(12) United States Patent
Lagree

(10) Patent No.: US 9,868,018 B2
(45) **Date of Patent: *Jan. 16, 2018**

(54) MULTIPLE POSITION LOCKING HANDLE FOR AN EXERCISE MACHINE

(71) Applicant: Lagree Technologies, Inc., Burbank, CA (US)

(72) Inventor: Sebastien Anthony Louis Lagree, Burbank, CA (US)

(73) Assignee: Lagree Technologies, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/665,314

(22) Filed: Jul. 31, 2017

(65) Prior Publication Data

US 2017/0326406 A1 Nov. 16, 2017

Related U.S. Application Data

(63) Continuation of application No. 15/442,943, filed on Feb. 27, 2017, now Pat. No. 9,717,945, which is a (Continued)

(51) Int. Cl.
*A63B 26/00* (2006.01)
*A63B 21/00* (2006.01)

(Continued)

(52) U.S. Cl.
CPC ..... *A63B 21/4035* (2015.10); *A63B 21/0125* (2013.01); *A63B 21/023* (2013.01);

(Continued)

(58) Field of Classification Search
CPC ..... A63B 21/1465; A63B 21/1469
See application file for complete search history.

(56) References Cited

U.S. PATENT DOCUMENTS 4,226,415 A * 10/1980 Wright ..... A63B 23/03525 482/113
4,397,462 A * 8/1983 Wilmarth ..... A63B 21/0087 482/113

(Continued)

OTHER PUBLICATIONS

Picture of a Product Developed by the Inventor, Sebastien Lagree, in 2007.

(Continued)

*Primary Examiner* — Loan H Thanh
*Assistant Examiner* — Rae Fischer
(74) *Attorney, Agent, or Firm* — Neustel Law Offices

(57) ABSTRACT

A multiple position locking handle for an exercise machine for that is movable into a plurality of different positions when unlocked and that is retained in a single secure position when locked. The multiple position locking handle for an exercise machine generally includes a tubular base having a lower end and an upper end, an elongated member extending through the opening of the upper end of the tubular base and extending downwardly through at least a portion of the tubular base, a handle extending outwardly from the elongated member at an angle, and a locking device. The elongated member is movable within the tubular base when the locking device is in the unlocked state and is substantially not movable within the tubular base when the locking device is in the locked state.

41 Claims, 22 Drawing Sheets

Related U.S. Application Data continuation of application No. 15/360,093, filed on Nov. 23, 2016, now Pat. No. 9,579,536, which is a continuation of application No. 15/146,622, filed on May 4, 2016, now Pat. No. 9,522,299, which is a continuation-in-part of application No. 14/841,210, filed on Aug. 31, 2015, now Pat. No. 9,474,924, which is a continuation of application No. 13/924,088, filed on Jun. 21, 2013, now Pat. No. 9,119,989, said application No. 15/442,943 is a continuation-in-part of application No. 14/065,851, filed on Oct. 29, 2013, now abandoned, which is a continuation-in-part of application No. 13/068,795, filed on May 20, 2011, now Pat. No. 8,641,585, and a continuation-in-part of application No. 13/924,088, filed on Jun. 21, 2013, now Pat. No. 9,119,989.

(60) Provisional application No. 61/719,763, filed on Oct. 29, 2012, provisional application No. 61/806,655, filed on Mar. 29, 2013, provisional application No. 61/719,757, filed on Oct. 29, 2012, provisional application No. 62/156,614, filed on May 4, 2015.

(51) Int. Cl.

| | |
|---|---|
| ***A63B 21/012*** | (2006.01) |
| ***A63B 21/02*** | (2006.01) |
| ***A63B 21/04*** | (2006.01) |
| ***A63B 22/00*** | (2006.01) |
| *A63B 23/02* | (2006.01) |
| *A63B 23/12* | (2006.01) |
| *A63B 71/00* | (2006.01) |
| *A63B 23/00* | (2006.01) |

(52) U.S. Cl.

CPC ..... *A63B 21/0407* (2013.01); *A63B 21/4001* (2015.10); *A63B 21/4029* (2015.10); *A63B 21/4045* (2015.10); *A63B 22/0046* (2013.01); *A63B 22/0087* (2013.01); *A63B 21/00061* (2013.01); *A63B 21/00065* (2013.01); *A63B 21/0428* (2013.01); *A63B 23/0211* (2013.01); *A63B 23/1236* (2013.01); *A63B 71/0054* (2013.01); *A63B 2023/003* (2013.01); *A63B 2208/0214* (2013.01); *A63B 2225/09* (2013.01)

(56) References Cited

U.S. PATENT DOCUMENTS

| | | | | |
|---|---|---|---|---|
| 4,725,057 A * | 2/1988 | Shifferaw | ..... | A63B 21/026 482/121 |
| 5,211,617 A * | 5/1993 | Millen | ..... | A63B 21/0455 482/127 |
| 8,641,585 B2 * | 2/2014 | LaGree | ..... | A63B 21/023 482/92 |

OTHER PUBLICATIONS

Picture of Megaformer M2 Exercise Machine; Black and White; Jan. 1, 2011.

Pictures of Megaformer product developed by the inventor, Sebastien Lagree; Black and White; Printed and Received Feb. 4, 2011.

Picture of Proformer Exercise Machine; Dec. 31, 2008.

Pictures of Megaformer M2 Exercise Machine; Color; Jan. 1, 2011.

https://web.archive.org/web/20100501142110/http:/spxfitness.com/index.php?option=com_content&view=article&id=32&Itemid=3;SPX Fitness Superformer Webpage Screenshot; May 1, 2010.

* cited by examiner

MULTIPLE POSITION LOCKING HANDLE FOR AN EXERCISE MACHINE

CROSS REFERENCE TO RELATED APPLICATIONS

The present application is a continuation of U.S. application Ser. No. 15/442,943 filed on Feb. 27, 2017 issuing as U.S. Pat. No. 9,717,945 on Aug. 1, 2017, which is a continuation of U.S. application Ser. No. 15/360,093 filed on Nov. 23, 2016 now issued as U.S. Pat. No. 9,579,536, which is a continuation of U.S. application Ser. No. 15/146,622 filed on May 4, 2016 now issued as U.S. Pat. No. 9,522,299, which is a continuation-in-part of U.S. application Ser. No. 14/841,210 filed on Aug. 31, 2015 now issued as U.S. Pat. No. 9,474,924, which is a continuation of U.S. application Ser. No. 13/924,088 filed on Jun. 21, 2013 now issued as U.S. Pat. No. 9,119,989, which claims priority to U.S. Provisional Application No. 61/719,757 filed Oct. 29, 2012. U.S. application Ser. No. 15/146,622 filed on May 4, 2016 also claims priority to U.S. Provisional Application No. 62/156,614 filed May 4, 2015.

U.S. application Ser. No. 15/442,943 filed on Feb. 27, 2017 issuing as U.S. Pat. No. 9,717,945 on Aug. 1, 2017 is also a continuation-in-part of U.S. application Ser. No. 14/065,851 filed on Oct. 29, 2013, which is a continuation-in-part of U.S. application Ser. No. 13/068,795 filed on May 20, 2011 now issued as U.S. Pat. No. 8,641,585 and which is a continuation-in-part of U.S. application Ser. No. 13/924,088 filed on Jun. 21, 2013 now issued as U.S. Pat. No. 9,119,989 and which claims priority to U.S. Provisional Application No. 61/719,763 filed on Oct. 29, 2012 and which claims priority to U.S. Provisional Application No. 61/806,655 filed on Mar. 29, 2013.

Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a multiple position locking handle for an exercise machine that is movable into a plurality of different positions when unlocked and that is retained in a single secure position when locked.

Related Art

Any discussion of the related art throughout the specification should in no way be considered as an admission that such related art is widely known or forms part of common general knowledge in the field.

Pilates apparatuses are well known the fitness industry worldwide. As one of the fastest growing segments of the fitness industry, millions of exercisers are visiting Pilates studios where they perform a complex routine of exercises upon a Pilates apparatus. A Pilates apparatus has many functional accessories that are used at various times during a workout, such accessories including adjustable handles, foot bars, and a plurality of resistance springs. It is important that all support features, such as grab handles of an apparatus, are solidly affixed to the apparatus structure in such a manner so as to provide reliable and predictable support any time that an exerciser requires support. On the other hand, grab handles are often rotated or otherwise repositioned during an exercise routine, so they must be easily manipulated by the exerciser.

One potential problem with some adjustable grab handle mechanisms is that the grab handles may not affirmatively lock into a new position after adjustment. In the event an exerciser inadvertently pulls up on the handle during an exercise, the lifted handle may accidentally disengage the handle thereby allowing the handle to rotate or otherwise move unexpectedly.

Those skilled in the art will understand and immediately appreciate the need for a new and novel exerciser support handle system that provides for easy disengagement from a locked position to allow for handle repositioning, and that immediately locks into position once determined by the exerciser.

SUMMARY

An example embodiment of the present invention is directed to a multiple position locking handle for an exercise machine. The multiple position locking handle for an exercise machine includes a tubular base having a lower end and an upper end, an elongated member extending through the opening of the upper end of the tubular base and extending downwardly through at least a portion of the tubular base, a handle extending outwardly from the elongated member at an angle, and a locking device. The elongated member is movable within the tubular base when the locking device is in the unlocked state and is substantially not movable within the tubular base when the locking device is in the locked state.

There has thus been outlined, rather broadly, some of the features of the multiple position locking handle for an exercise machine in order that the detailed description thereof may be better understood, and in order that the present contribution to the art may be better appreciated. There are additional features of the multiple position locking handle for an exercise machine that will be described hereinafter and that will form the subject matter of the claims appended hereto. In this respect, before explaining at least one embodiment of the multiple position locking handle for an exercise machine in detail, it is to be understood that the multiple position locking handle for an exercise machine is not limited in its application to the details of construction or to the arrangements of the components set forth in the following description or illustrated in the drawings. The multiple position locking handle for an exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

An example multiple position locking handle for an exercise machine generally comprises a tubular base having a lower end and an upper end, an elongated member extending through the opening of the upper end of the tubular base and extending downwardly through at least a portion of the tubular base, a handle extending outwardly from the elongated member at an angle, and a locking device. The elongated member is movable within the tubular base when the locking device is in the unlocked state and is substantially not movable within the tubular base when the locking device is in the locked state.

"Pilates apparatus" as used herein may also include "machine", "exercise apparatus", or "exercise machine" with no difference in meaning or intention as the descriptions are interchangeable. U.S. Pat. Nos. 7,803,095 and 8,641,585 illustrate exemplary exercise machines comprised of a "Pilates apparatus" and are hereby incorporated by reference herein.

Figure 1:
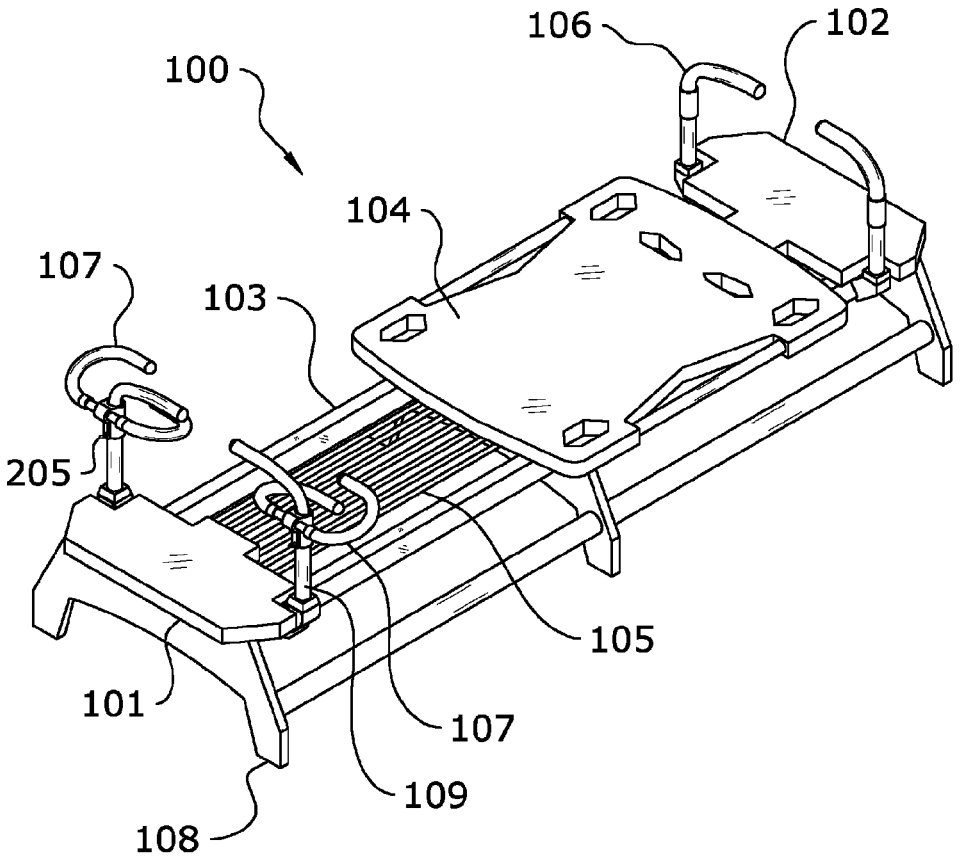
FIG. 1 is a perspective view of a plurality of multiple position locking handles attached to an exercise machine in accordance with one example embodiment.

FIG. 1 is an exemplary diagram showing an exercise machine (e.g. a Pilates apparatus) 100 comprising a structural support frame with a first end 101 and a distal second end 102, a pair of parallel sliding rails 103 affixed to a plurality of laterally extending structural supports 108, and an exercise carriage 104 slidable along substantially the length of the parallel rails. A plurality of resistance springs 105 are removably attached between the first end of the apparatus and the slidable carriage, the thereby providing for a resistance force against which an exerciser will work in order to slide the carriage in a direction opposite to the resistance means.

A pair of support handles 106 are shown at the second end of the apparatus, and a pair of multiple handle support structures 107 are shown affixed to the apparatus proximal to the first end. The handles of the multiple support handle structures are rotatable about the axis of the supporting stanchions 109.

When changing from one exercise to a second exercise during a workout session, exercisers will preferably reposition one or more of the handles of the multiple handle support system to provide for improved grabbing or pushing support.

Figure 2A:
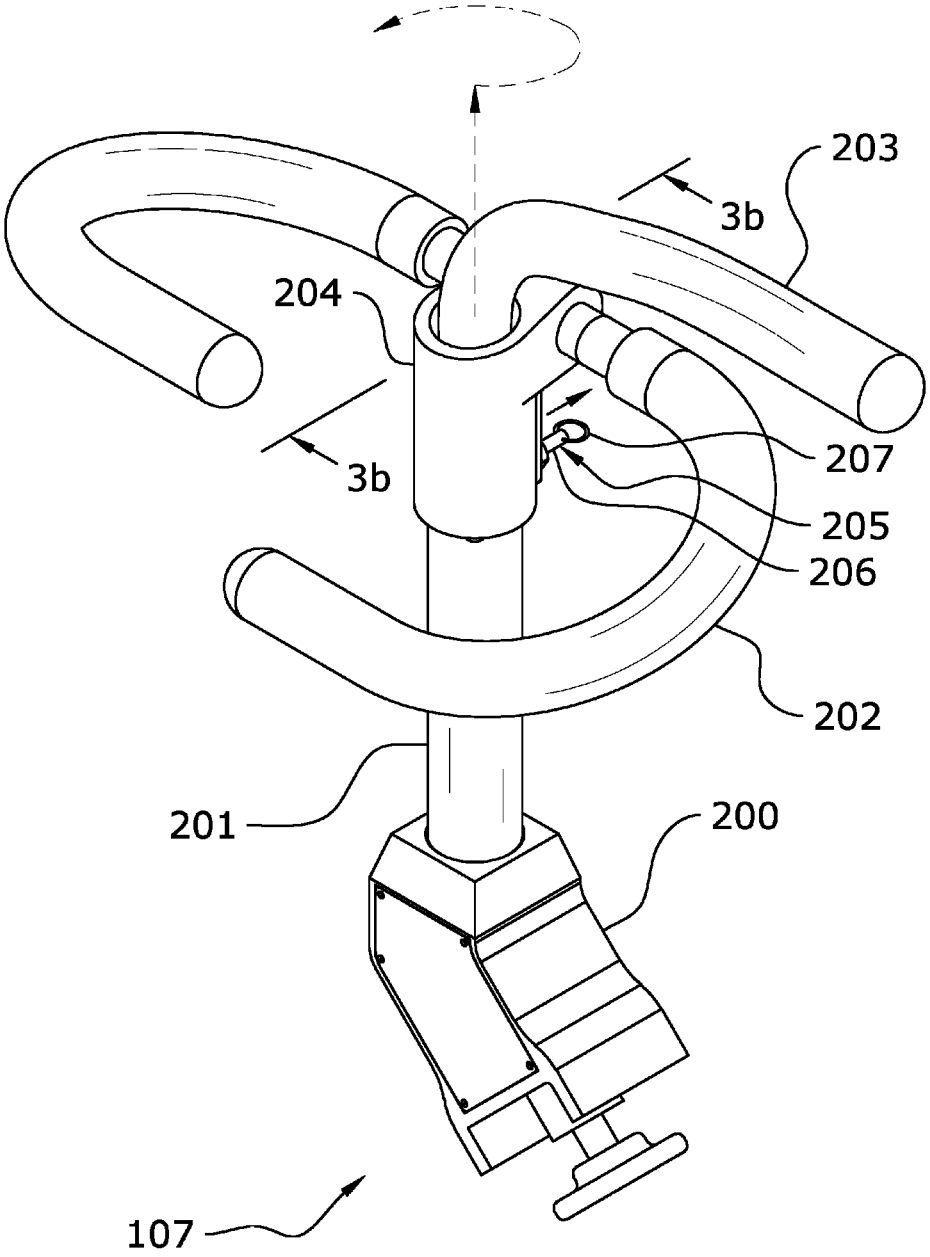
FIG. 2*a* is a perspective view of an embodiment of the multiple position locking handle.

FIG. 2*a* is an exemplary diagram showing a first position of handles of a multiple support handle system 107 of an exercise apparatus. A support base 200 is affixed to the structure of an exercise apparatus, thereby supporting a vertically extending stanchion 201 there above. The assembly further supports a lower set of handles 202 and an upper handle 203. The handles are shown in one of many possible locked positions, and are independently rotatable about the longitudinal axis of the stanchion 201.

Figure 2B:
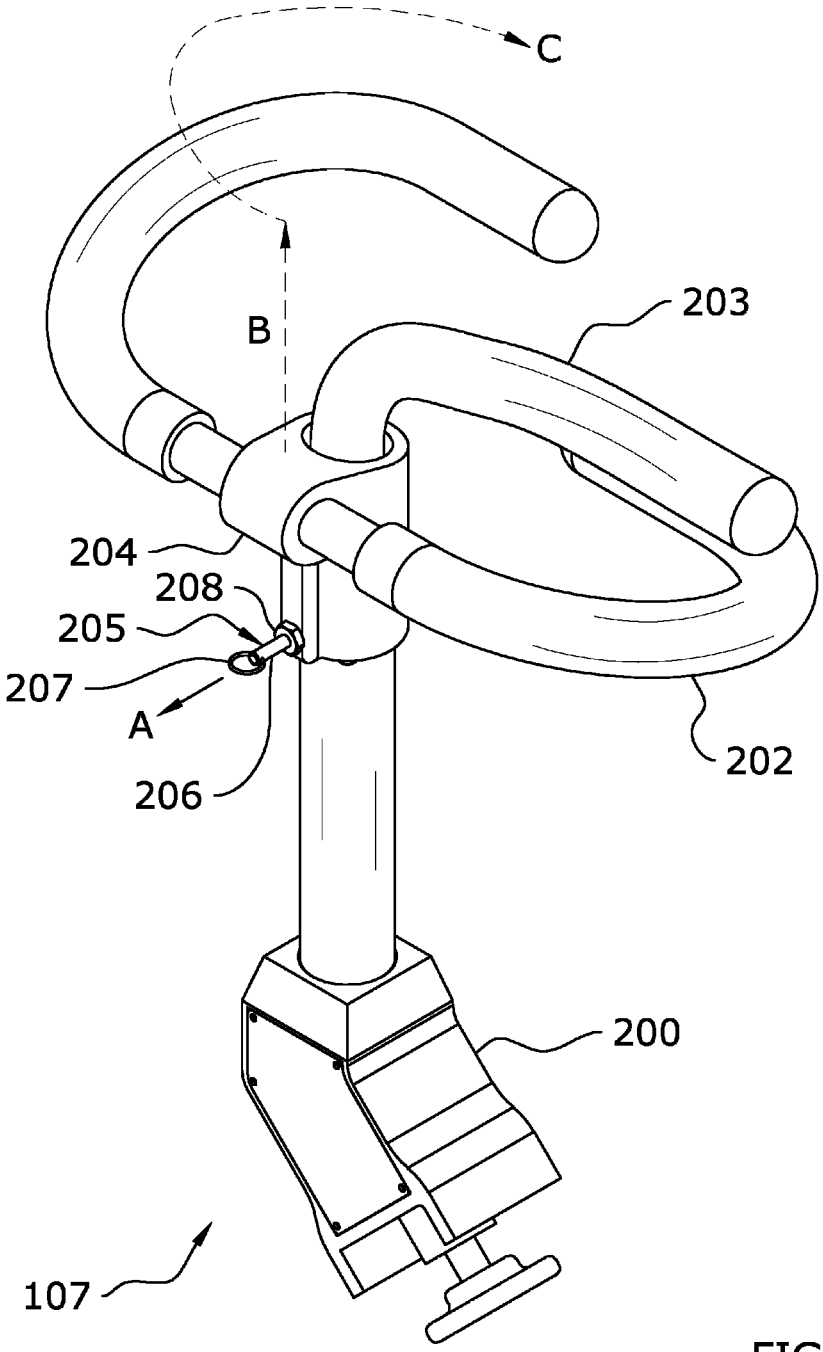
FIG. 2*b* is a perspective view of an embodiment of the multiple position locking handle with the locking device in an unlocked position and with the handles being lifted and rotated thereafter.

FIG. 2*b* is an exemplary diagram showing a second position of handles of a multiple handle system 107 of an exercise apparatus. In FIG. 2*b*, the locking device 205 is shown installed into an internally slotted hub 204 in one embodiment of the invention. The locking device 205 may alternatively be attached to the tubular base 201 and selectively engages the elongated member 430 to prevent rotation and/or lifting of the elongated member 430 with respect to the tubular base 201. The locking device 205 includes a body 208 that may be threaded on the exterior portion to be threadably attached within a threaded aperture within the hub 204 or the tubular base 201. The plunger pin 206 slidably extended within the body 208 with the spring 209 providing a biasing force to the plunger pin 206 with respect to the body 208 thereby forcing the distal end portion of the plunger pin 206 to extend inwardly out of the body 208 and out of the hub 204 (or the tubular base 201) to extend inwardly to catchably engage the latch 400 to prevent the elongated member 430 from being lifted upwardly or rotated.

A handle 207 is attached to the outer distal end of the plunger pin 206 for a user to easily grasp and pull upon the plunger pin 206. The handle 207 may be comprised of a ring or other structure that is easily grasped with the fingers. The handle 207 may be pivotally or other otherwise movably connected to the plunger pin 206.

The locking device 205 may be comprised of any spring-loaded plunger device that uses a biasing device 209 (e.g. spring, compression spring) to apply a biasing force to a plunger pin 206 such as, but not limited to, a spring plunger, an index plunger or a pull-ring index plunger. The biasing force applied to the plunger pin forces the plunger pin to retract from an outwardly pulled extended position. An upper handle 203 is shown extending down through the top surface of the hub 204.

Referencing the positions of the handles of FIG. 2*a*, it can be readily seen that the lower handles 202 have been rotated about the longitudinal axis of the stanchion. The repositioning of the lower handles 202 includes the user first pulling outwardly on the spring plunger 205 in direction A thereby releasing the plunger from one of a plurality of latches 400 internal to the hub 204. Releasing the plunger from the latch allows for the upward lifting of the hub 204, and correspondingly the lower handles 202 affixed to the hub in direction B. Lifting the internally slotted hub provides for raising the internal slots of the hub from radially projecting gear teeth of a lower gear ring affixed proximal to the upper end of the stanchion, thereby allowing the handle and hub assembly to be rotated about the longitudinal axis of the stanchion in rotational direction C (or a counter rotational direction). Upon finding a preferred axial position of the handle and hub assembly, the position corresponding to one of a plurality of possible positions as determined by the number of internal slots and mating gear teeth projections radially from the central axis of the stanchion, the exerciser drops the hub and handle bar assembly downward, thereby allowing the spring plunger to engage another latch in the new position.

Figure 3A:
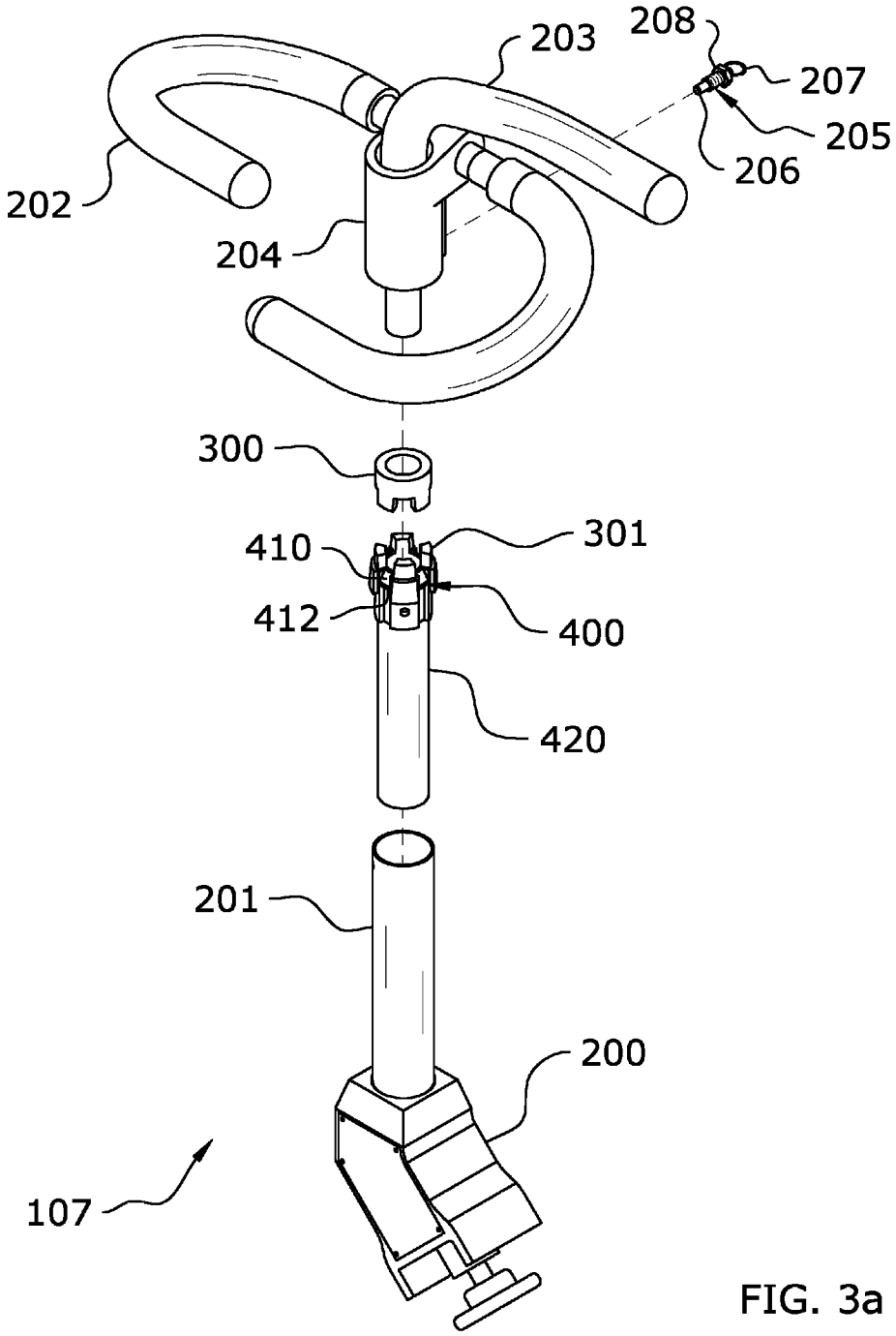
FIG. 3*a* is an exploded perspective view of an embodiment of the multiple position locking handle.

FIG. 3*a* is an exemplary diagram showing an exploded view of a multiple support handle system of an exercise apparatus. A support base 200 is affixed to the structure of an exercise apparatus not shown, thereby supporting a vertically extending stanchion 201 there above. The assembly further supports a lower set of handles 202 and an upper handle 203. The handles are shown in one of many possible locked positions, and are independently rotatable about the longitudinal axis of the stanchion 201. When rotated to a preferred position, the position is maintained by means of a spring plunger 205 engaging with a mating latch not shown, but internal to the assembly.

A lower gear ring 301 is directly or indirectly affixed proximal to the uppermost end of the stanchion. Radially projecting gear teeth of the lower gear ring engage with corresponding slots internal to the handle hub 204. An elongated spacer 420 is attached to the lower portion of the lower locking member 301 to provide a spacer for the compression spring that is attached to the lower end of the elongated member 430 by an end member (the compression spring is compressed between the lower end of the elongated spacer 420 and the end member which is wider than the elongated member 430.

Further, upwardly projecting teeth of the lower gear tooth may engage corresponding teeth of an upper gear ring 300 which is affixed proximal to the lower vertical end of the upper handle 203.

Figure 3B:
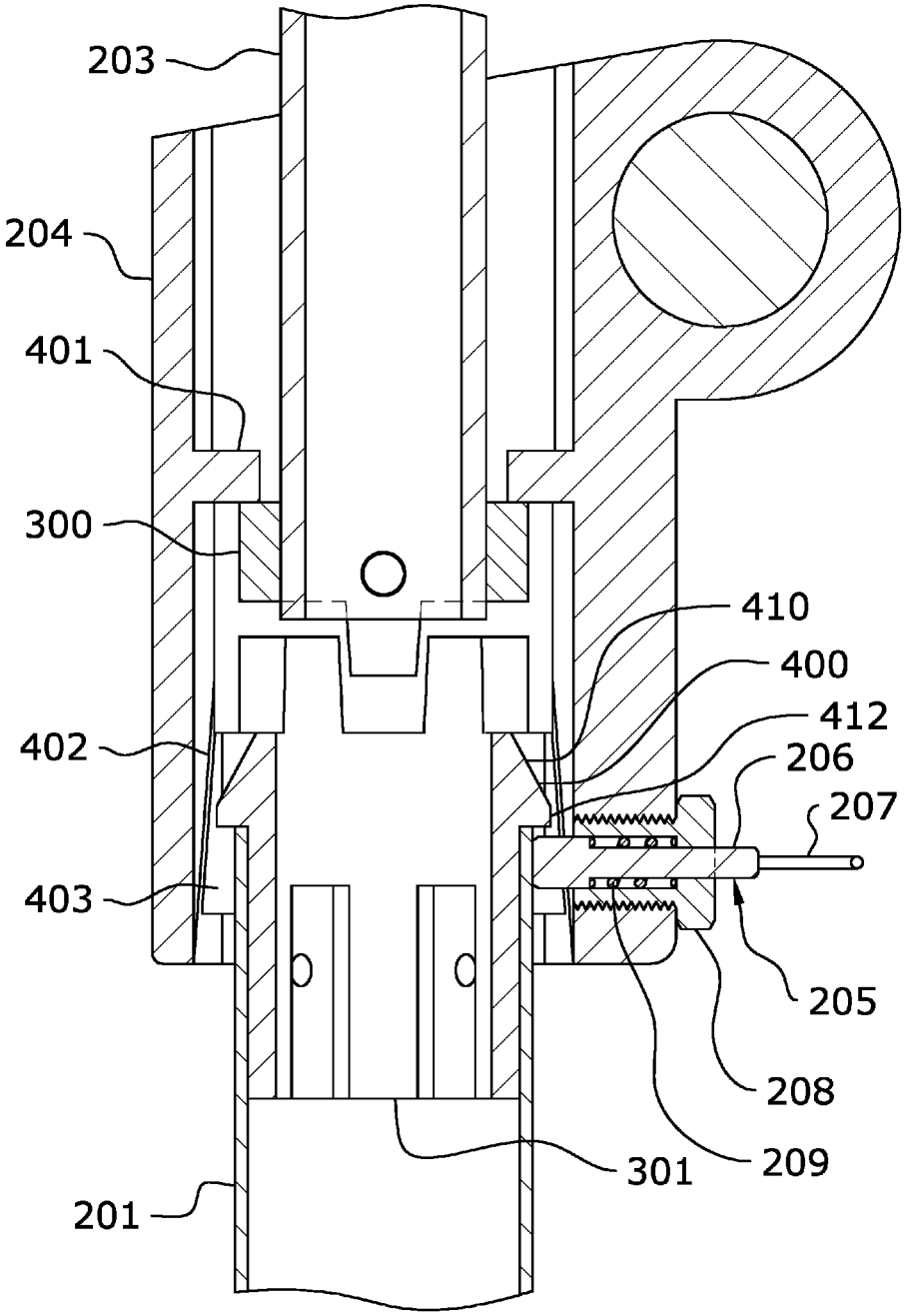
FIG. 3*b* is a cutaway view taken along line 3*b*-3*b* of FIG. 2*b* showing the locking device and related rotational locking assembly.
Figure 4:
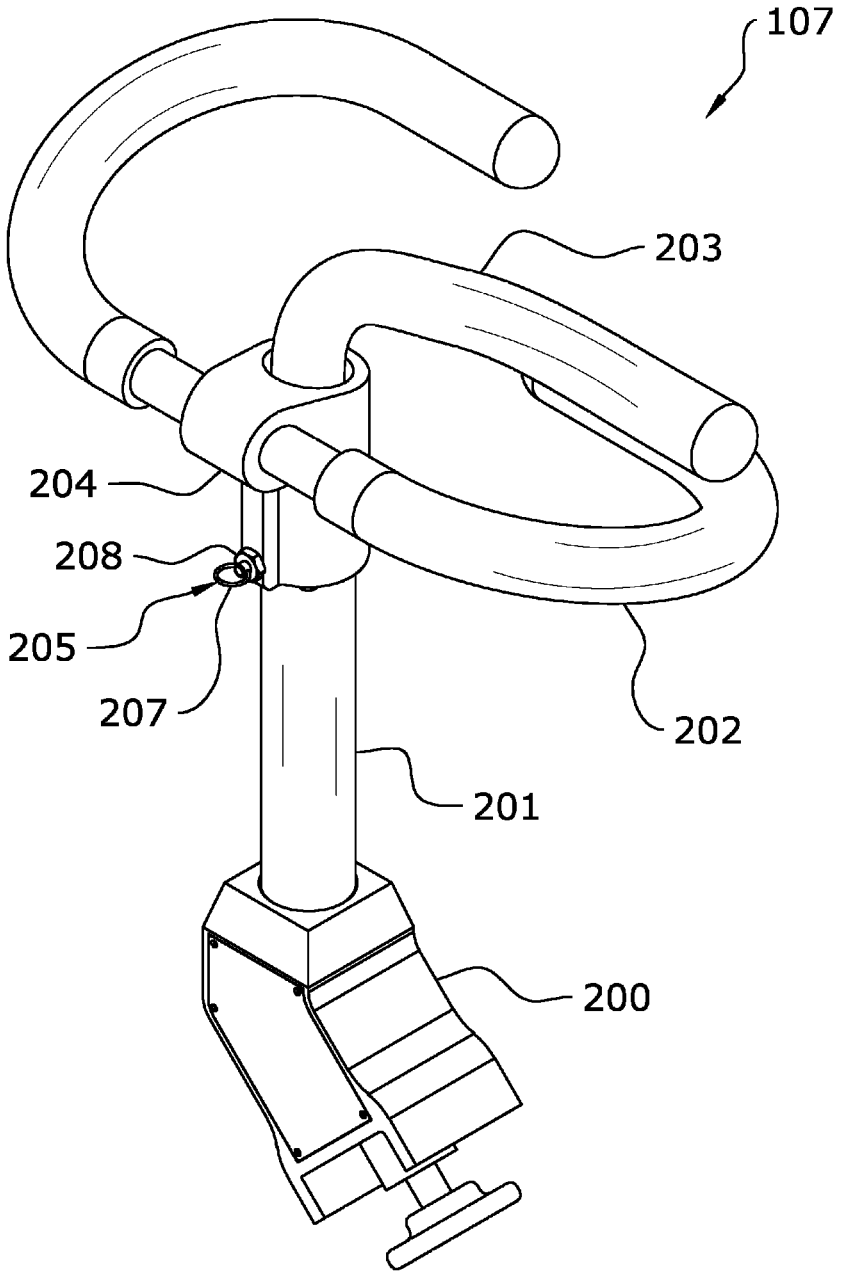
FIG. 4 is a perspective view of an embodiment of the multiple position locking handle with the locking device in the locked position.
Figure 5:
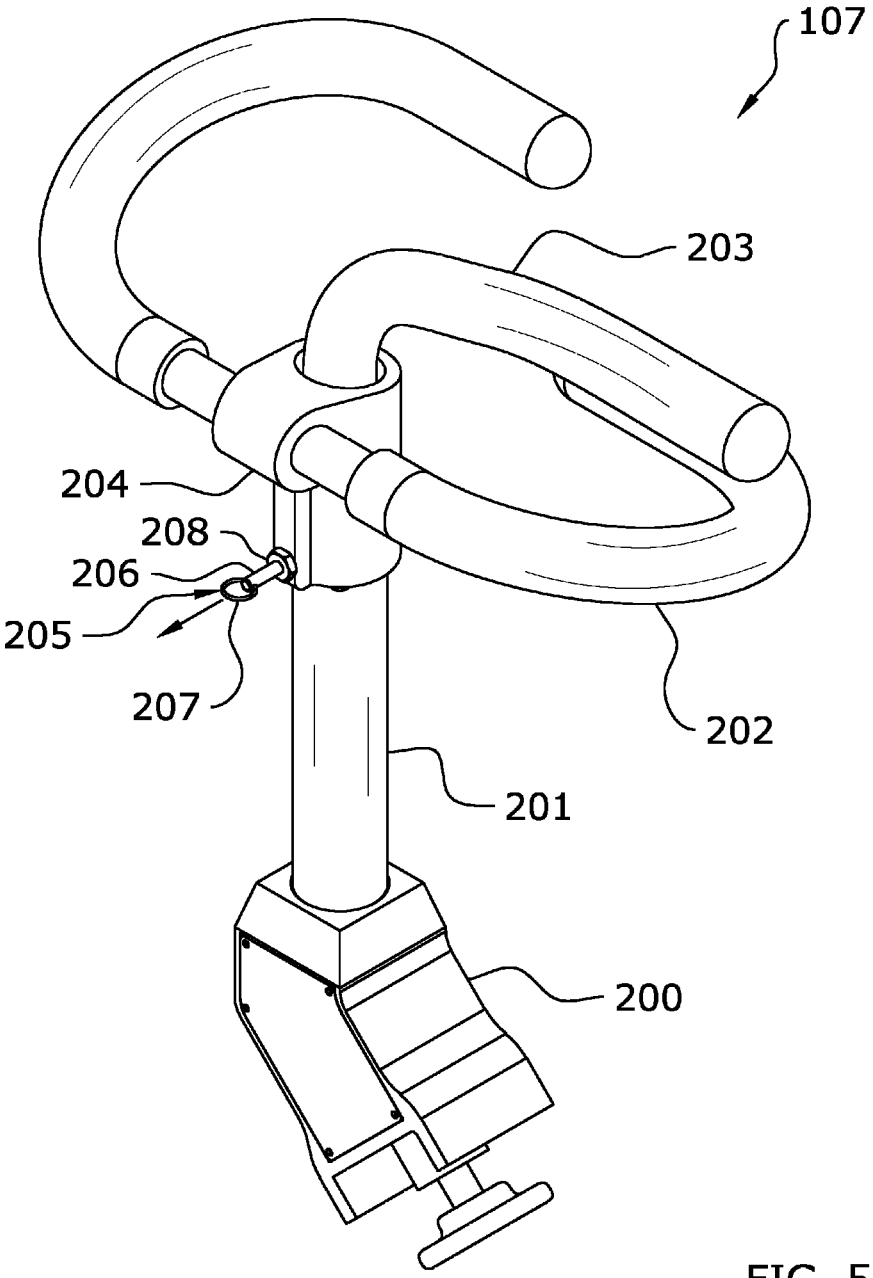
FIG. 5 is a perspective view of an embodiment of the multiple position locking handle with the locking device in the unlocked position with the handles still in a rotational locked state.
Figure 6:
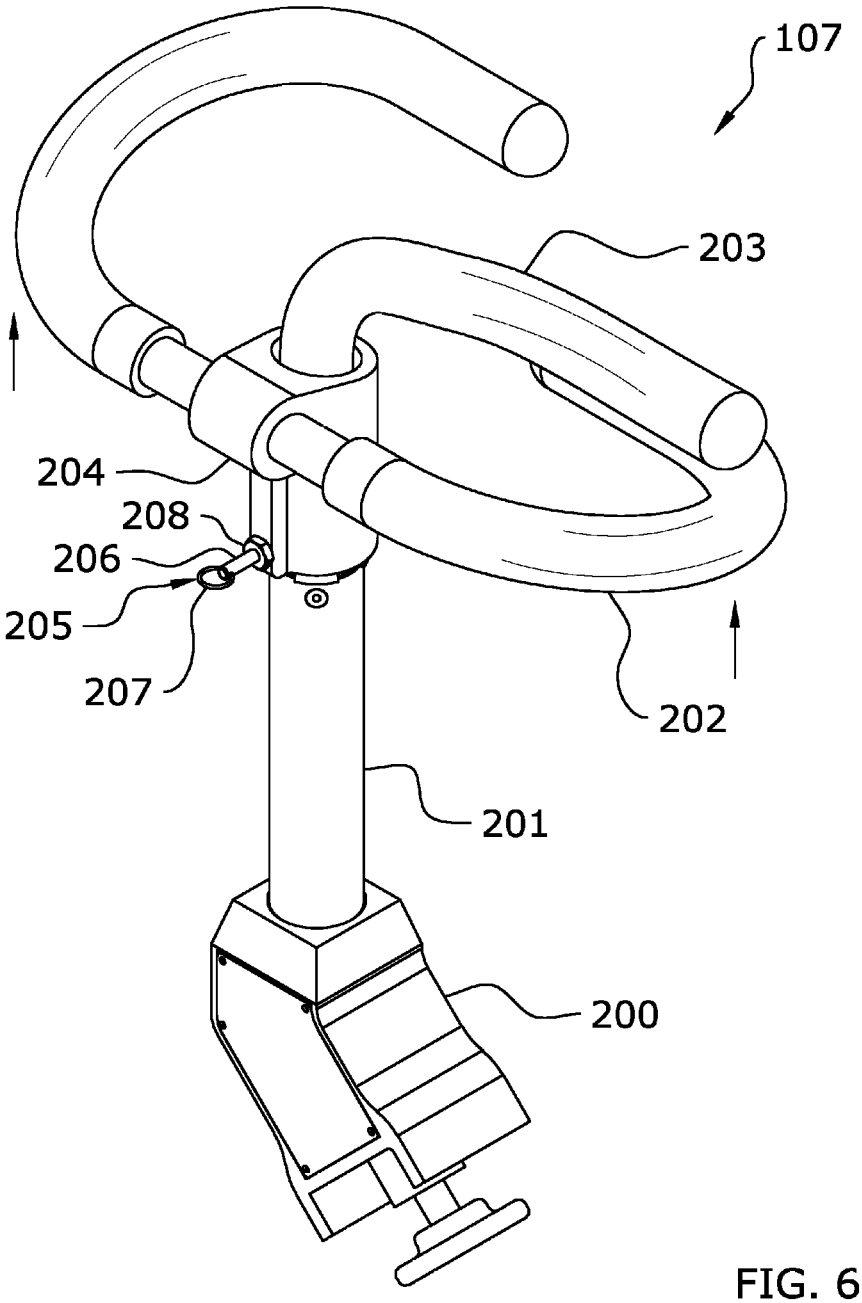
FIG. 6 is a perspective view of an embodiment of the multiple position locking handle with the locking device in the unlocked position and the handles being lifted upwardly to enter a rotational released state.
Figure 7:
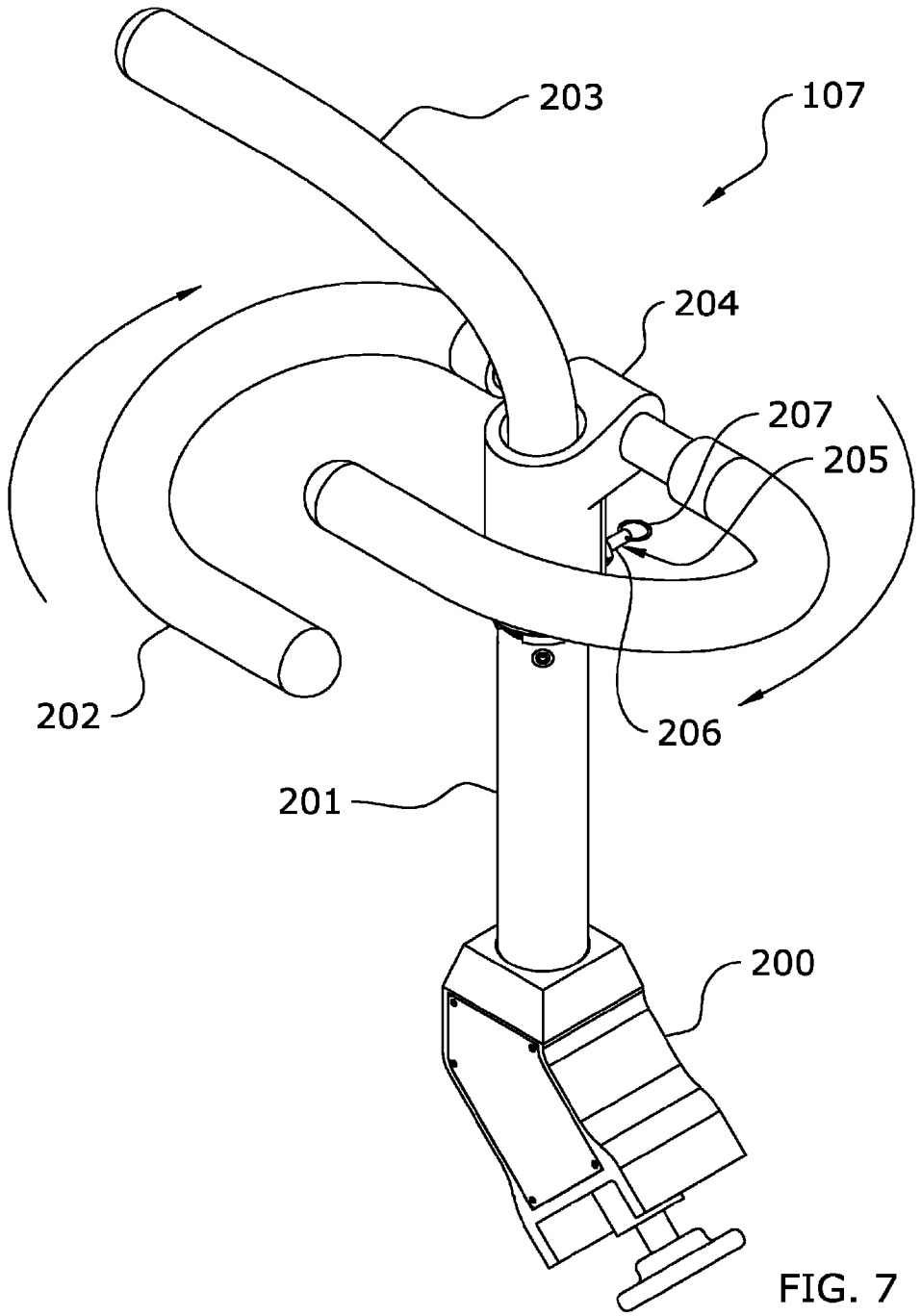
FIG. 7 is a perspective view of an embodiment of the multiple position locking handle with the locking device in the unlocked position and the handles being lifted upwardly into the rotational released state and with the handles being freely rotated.
Figure 8:
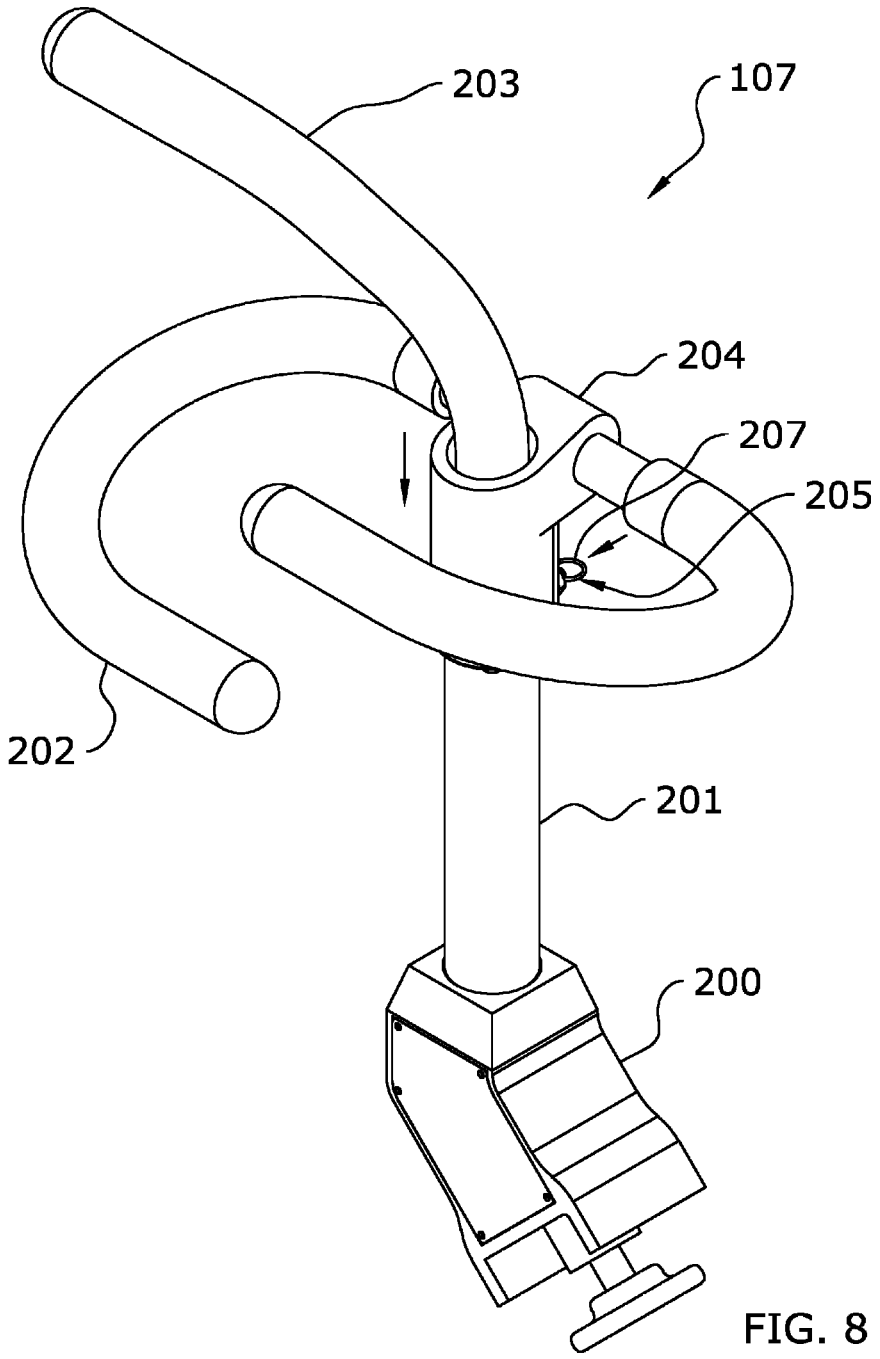
FIG. 8 is a perspective view of an embodiment of the multiple position locking handle with the handles lowered back into the rotational locked state and the locking device in the locked position to prevent the handles from being lifted upwardly.
Figure 9:
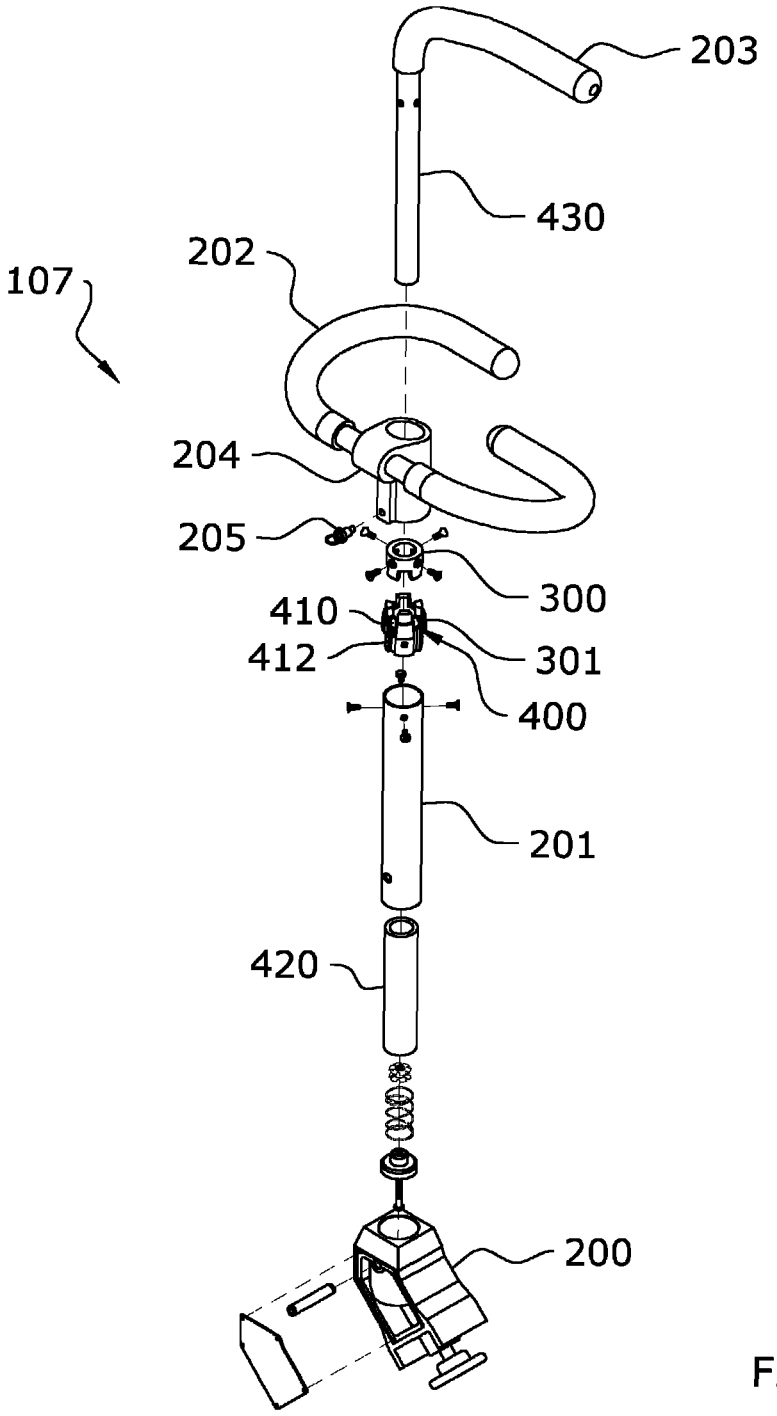
FIG. 9 is an exploded perspective view of an embodiment of the multiple position locking handle.
Figure 10:
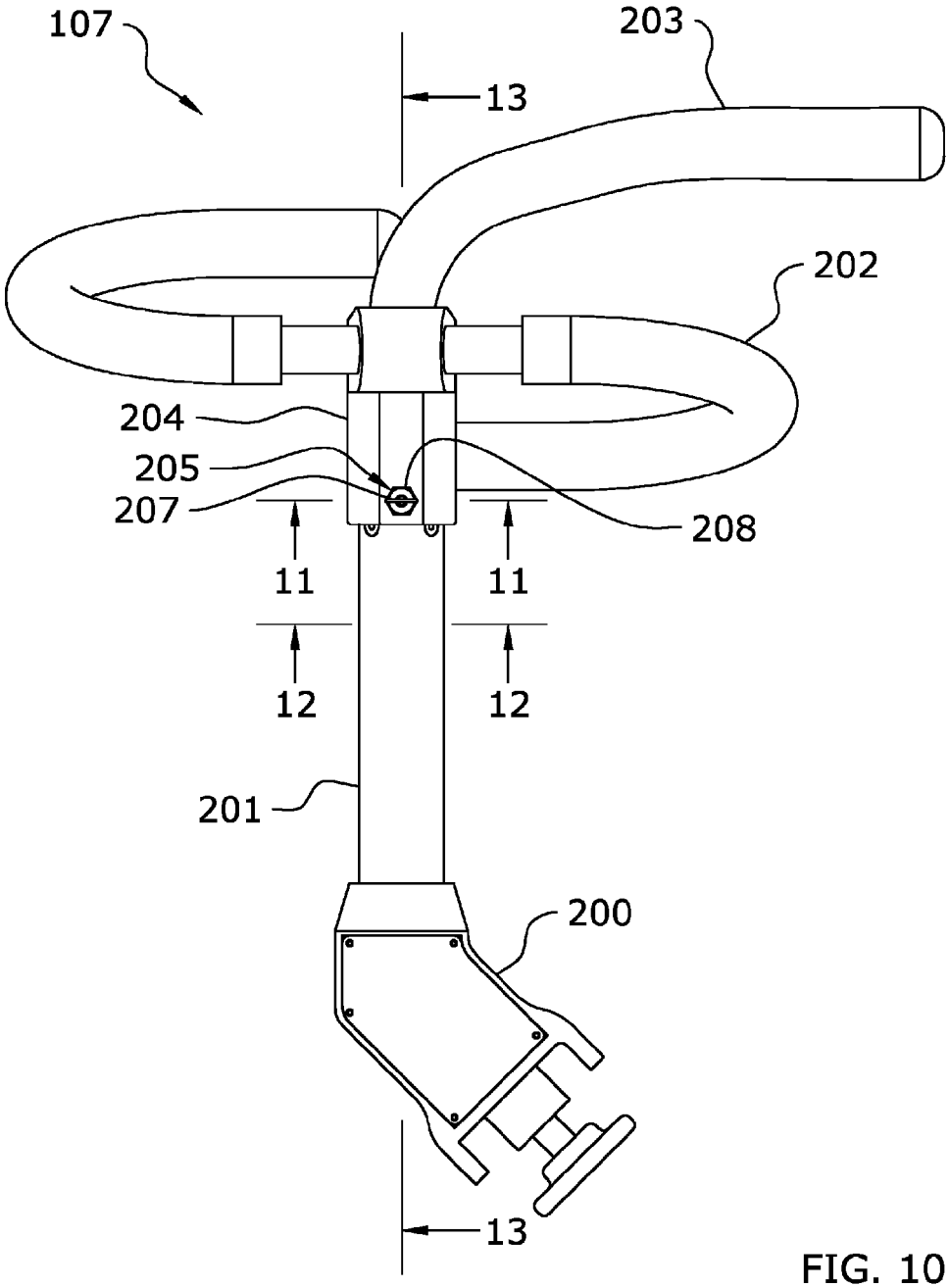
FIG. 10 is a front view of an embodiment of the multiple position locking handle.
Figure 11:
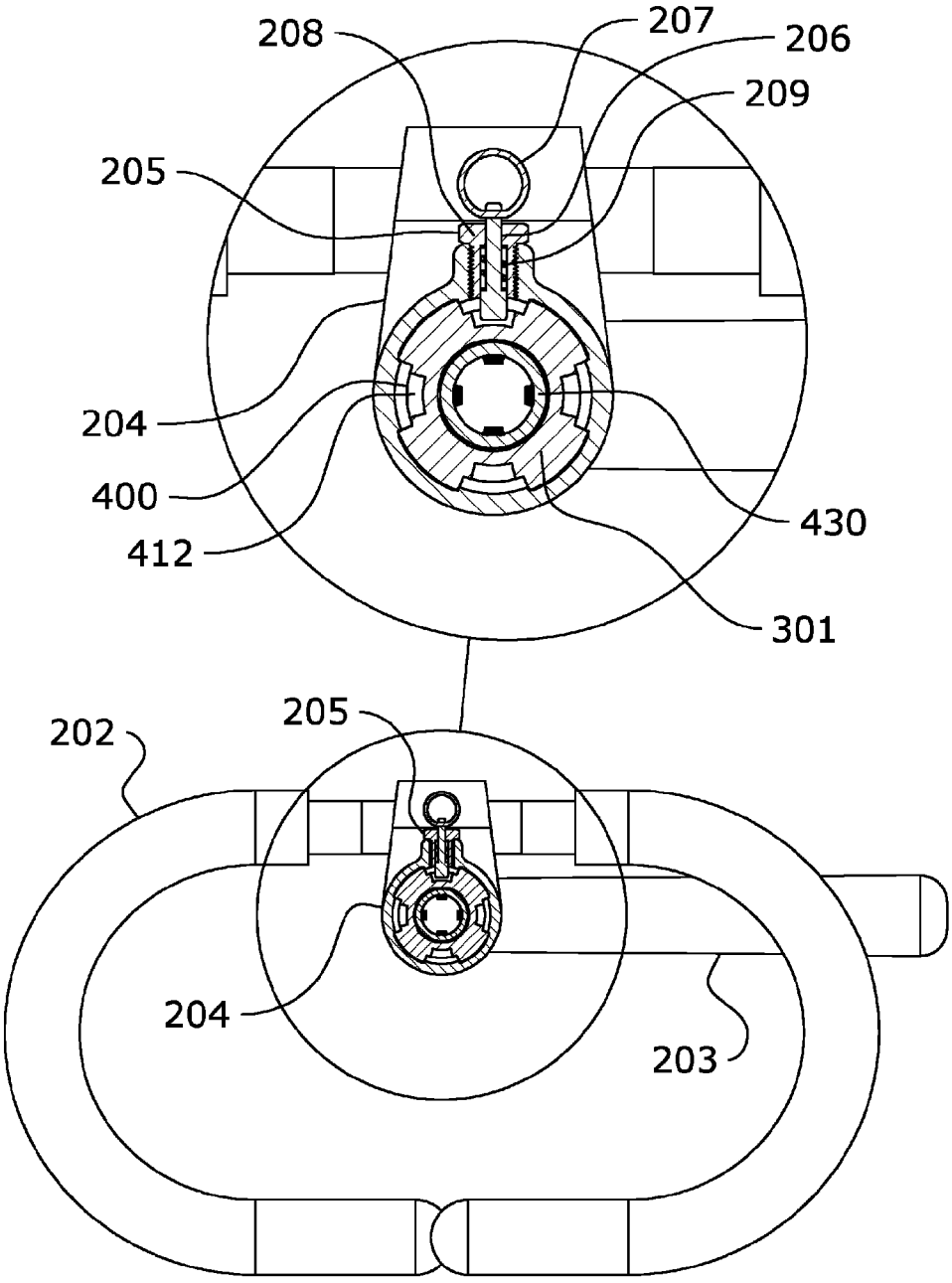
FIG. 11 is a cross sectional view taken along line 11-11 of FIG. 10.
Figure 12:
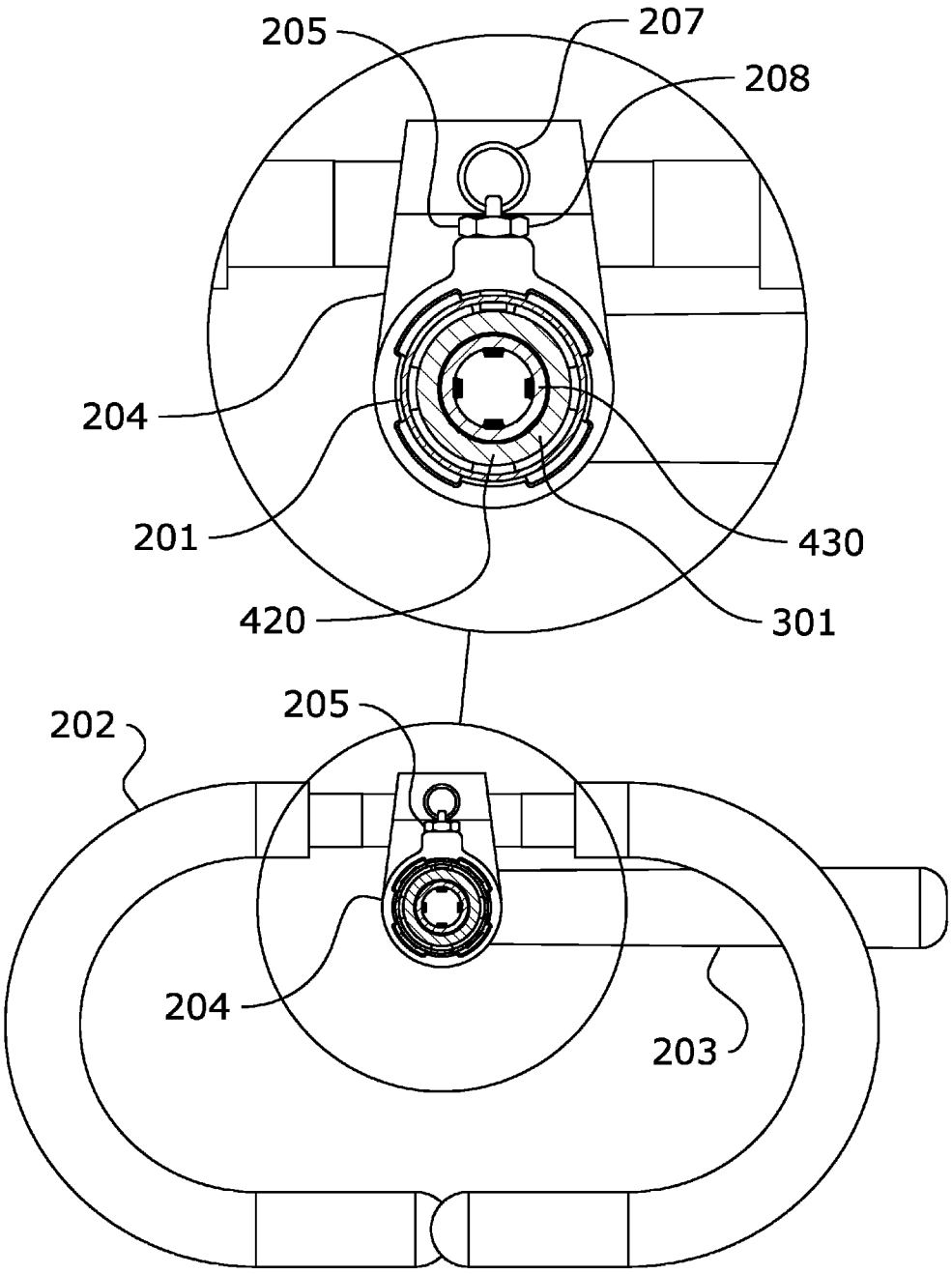
FIG. 12 is a cross sectional view taken along line 12-12 of FIG. 10.

FIG. 3*b* is an exemplary diagram showing a sectional view 3B-3B of a locking mechanism of a multiple support handle system of FIG. 2*b*. The lower end of a substantially tubular upper handle 203 is shown projecting through the top surface of a handle hub 204. An upper gear ring 300 is affixed proximal to the lower end of the handle tube, with gear teeth projecting in a downward direction so as to engage with corresponding gear teeth of the lower gear ring 301. The lower gear ring is affixed proximal to the upper end of the stanchion tube 201.

Further to the upwardly extending gear teeth of the lower gear ring 301, the lower gear ring has a plurality of vertical projections 403 positioned radially about the vertical axis, the projections engageable with internal slots 402 of the internally slotted hub 204. Aligning the mating vertical projections and slots positions the hub at one of a plurality of radial positions. Lifting the internally slotted hub de-engages the radial projections of the lower gear ring from the internal slots of the hub, thereby allowing the hub, and correspondingly the handles about the longitudinal axis of the stanchion.

A plurality of latches 400 are provided axially about the lower locking member or lower gear ring, the latches being interstitial to the vertical projections. Before the internally slotted hub may be lifted relative to the stanchion, the plunger of a spring plunger 205 must be manually pulled by the exerciser in a direction that retracts the plunger from the latch 400. Only after retracting the plunger can an exerciser lift the hub and handles for the purpose of rotating to a new position.

Figure 17:
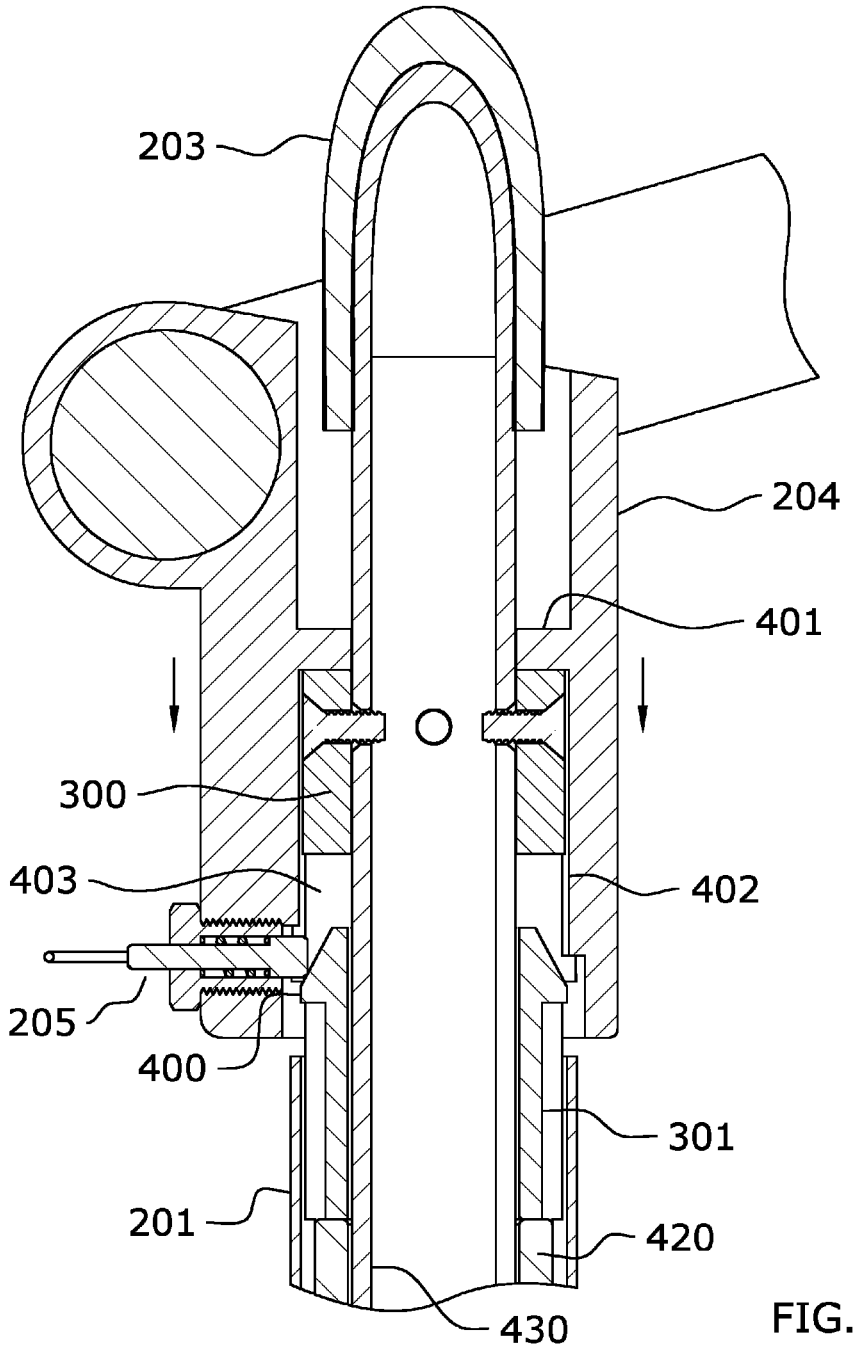
FIG. 17 is a side cutaway view showing the collar and handles connected to the collar being lowered downwardly with the plunger pin of the locking device sliding along the angled surface of the latch.
Figure 18:
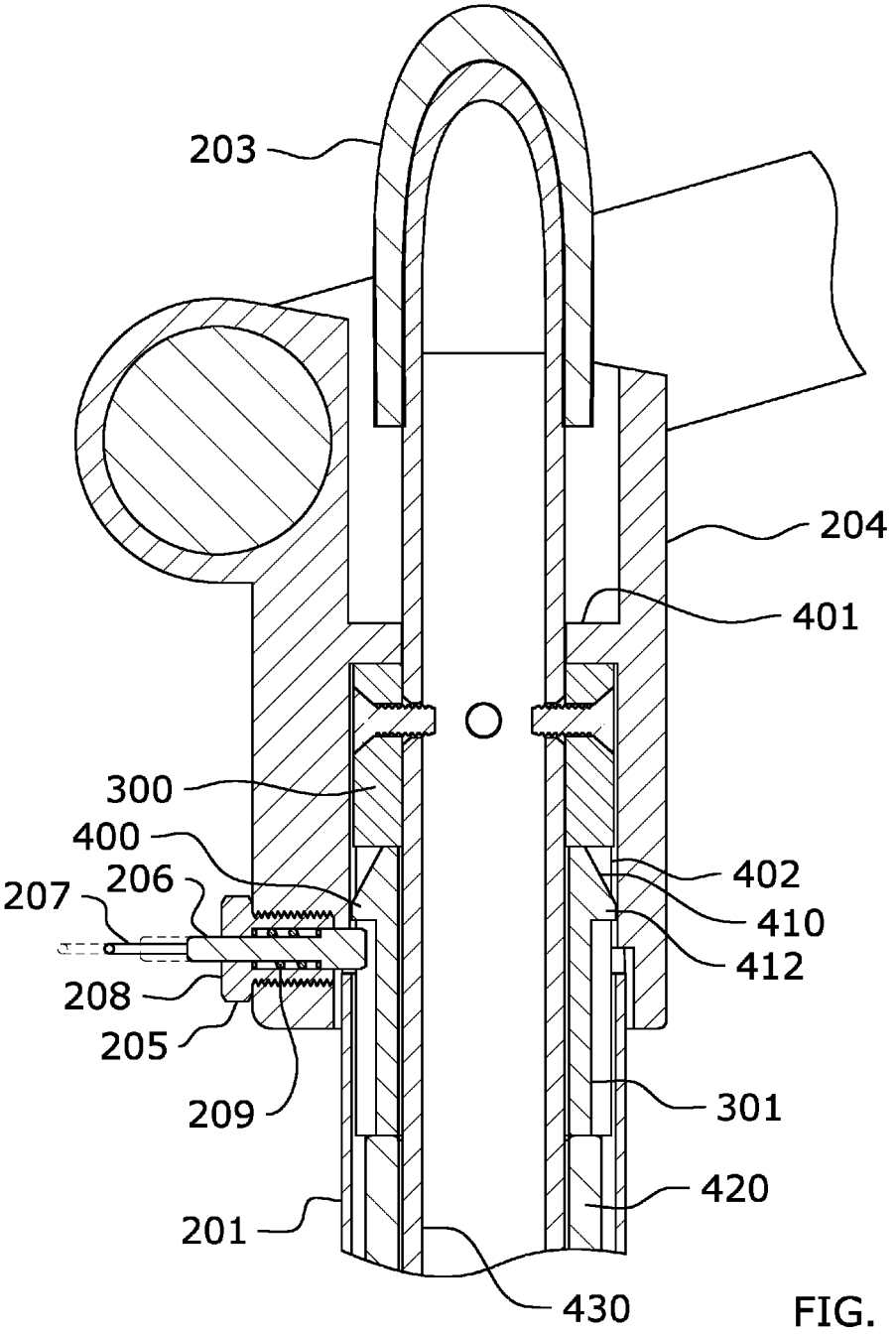
FIG. 18 is a side cutaway view showing the plunger pin of the locking device being biased inwardly to engage the latch in the locked position.
Figure 19:
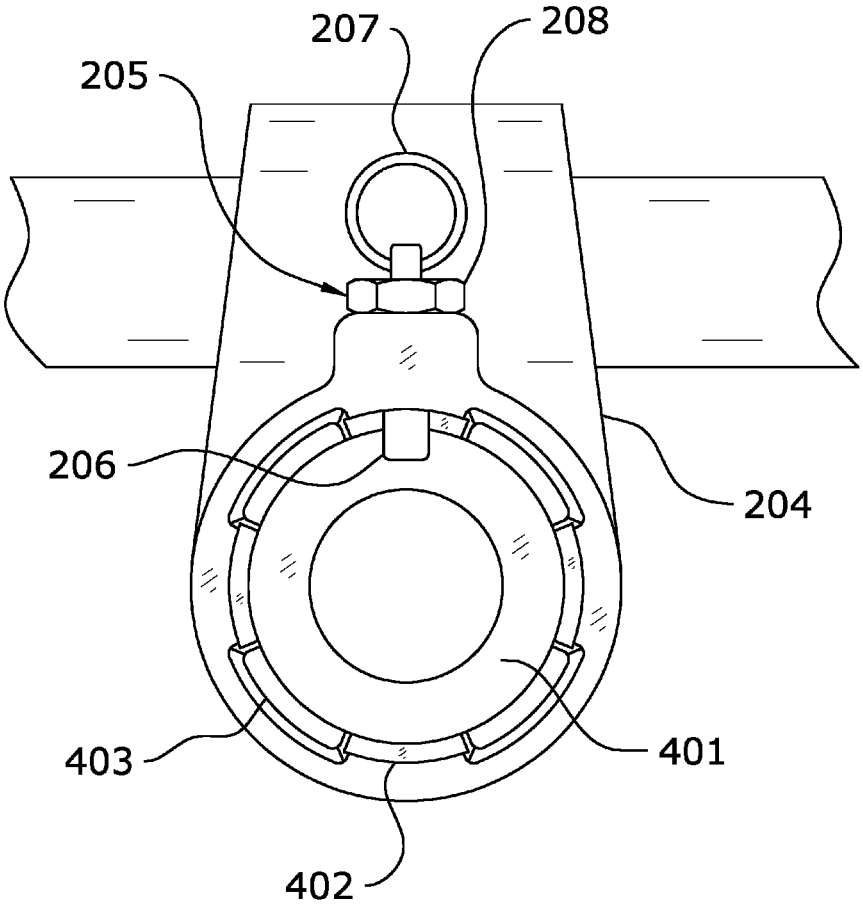
FIG. 19 is a bottom view of the collar that supports the handles.
Figure 20:
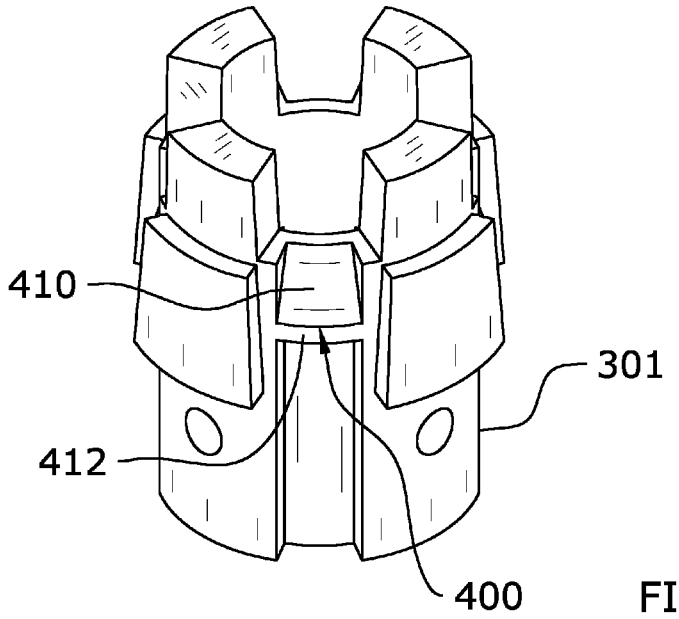
FIG. 20 is an upper perspective view of a lower locking structure that is attached to the tubular base.
Figure 21:
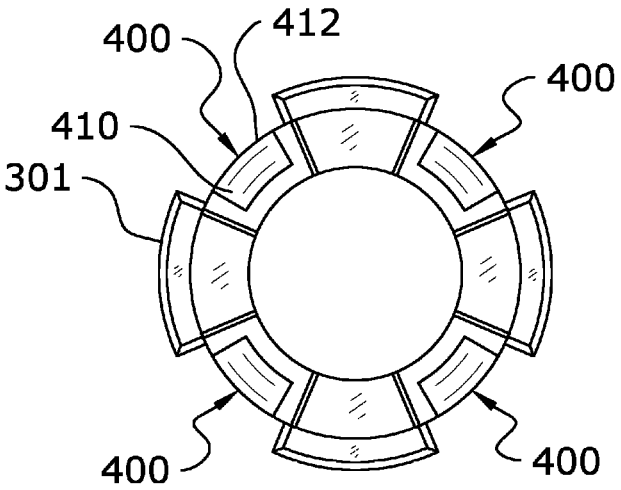
FIG. 21 is a top view of the lower locking structure.

The latches 400 may be comprised of various structures that may be catchably connected to the plunger pin 206 of the locking device 205. FIGS. 3*a*, 3*b*, 9, 12-18, 20 and 21 illustrate one embodiment of the lower locking member 301 having a plurality of the latches 400. Each of the latches shown in this embodiment includes an angled surface 410 that tapers outwardly from top to bottom as best illustrated in FIG. 3*b* of the drawings. The angled surface 410 may be a straight angled surface as illustrated in FIG. 3*b* or a non-straight angled surface. The upper portion of the angled surface 410 is positioned inwardly sufficiently that when the plunger pin 206 of the locking device 205 is fully extended inwardly that the plunger pin 206 does not catch on an upper edge of the lower locking member 301 and instead slidably engages the angled surface 410 to force the plunger pin 206 outwardly as the collar and handle connected to the collar are pushed downwardly upon the tubular base 201 as shown in FIG. 17 of the drawings. After the handle is pushed downwardly sufficiently, the plunger pin 206 is able to extend inwardly in a catchable manner (locked position) to extend below a lower edge of the corresponding latch 400 to prevent the collar (and handle) from being lifted upwardly as shown in FIG. 18. The lower edge 412 may be a substantially horizontally aligned surface as shown in FIGS. 3*b* and 18 of the drawings. However, the lower edge 412 may be comprised of various other structures not shown in the drawings capable of catchably engaging the plunger pin 206 when the plunger pin is extended inwardly into the locked position (e.g. an aperture within the elongated member 430.

Further, lifting the hub after retracting the spring plunger raises the annular ring retainer 401 on the interior of the hum, in turn, raising the ring vertically upwards from the upper gear ring 300. This provides for the upper handle 203 to be raised as well, so that the bottom of the upper gear teeth disengage from the upwardly projecting teeth of the lower gear ring. The upper handle gear ring being disengages provides for an exerciser to rotate the upper handle independent of the hub to the desired position.

A one or more gear teeth of each of the upper and lower gear rings, create a plurality of lockable handle positions. In one embodiment, four gear teeth of each of the upper and lower gear rings, creating a plurality of lockable handle positions at 0, 90, 180, and 270 degrees of rotation are created. Various other degrees of rotation may be created. Correspondingly, four latch 400 positions are interstitially positioned between the gear teeth, thereby providing for four locking positions. Alternatively, a single tooth may be used for the collar and handle that is selectively received in one of a plurality of apertures or cutouts within the lower locking member 301 or the tubular base 201. Various other structures may be utilized to provided for a plurality of locked rotation positions for the handle so that when the handle is lifted upwardly the handle is rotatable to a different rotation position and when the handle is lowered the handle is locked in a non-rotatable manner.

The 90 degree offsets for the gear teeth, and providing for four gear teeth and four positions for lockable rotation is not meant to be limiting, and any reasonable number of positions preferably symmetrically positioned radially about the longitudinal axis of the stanchion may be used.

One embodiment of the present invention includes a tubular base having a lower end and an upper end, wherein the tubular base is adapted to be attached to an exercise machine and wherein the upper end includes an opening. In addition, an elongated member extends through the opening of the upper end of the tubular base and extends downwardly through at least a portion of the tubular base. Alternatively, the base may extend through a lower opening in the elongated member with the elongated member having a tubular structure and slidably (and rotatably) surrounding the base (the base may be tubular or non-tubular). In addition, the base may be slidably and rotatably connected with the elongated member in various other manners not illustrated in the drawings. The elongated member is rotatable and slidable in a longitudinal manner with respect to the lumen of the tubular base to allow for rotational adjustment of the handle. The handle extends outwardly from the elongated member at an angle (e.g. horizontally, radially and various angles between horizontal and vertical), however, the handle may be concentric with the elongated member and extend substantially along a common axis of the elongated member. The locking device has a locked state and an unlocked state. The elongated member is movable within the tubular base when the locking device is in the unlocked state and the elongated member is substantially not movable within the tubular base when the locking device is in the locked state. When the elongated member is in the unlocked state, the elongated member is preferably movable within the tubular base.

The locking device (e.g. index plunger) is connected to the handle or the collar connected to the handle. The locking device includes a plunger pin and a spring connected to the plunger pin, wherein the spring applies a biasing force to the plunger pin forcing the plunger pin inwardly as illustrated in FIG. 14 through 28 of the drawings. Alternatively, the locking device is connected to the tubular base and extends inwardly to selectively engage the elongated member. The locking device engages the tubular base (e.g. latches of the lower locking member) when in the locked state thereby preventing the elongated member from moving substantially with respect to the tubular base. When in the locked state, the locking device prevents the elongated member from moving upwardly and may also prevent substantial rotation of the elongated member with respect to the tubular base. It is preferable that the arrangement of the locking device and locking members are such that there is no movement (rotational or longitudinal) of the elongated member with respect to the tubular base.

Figure 13:
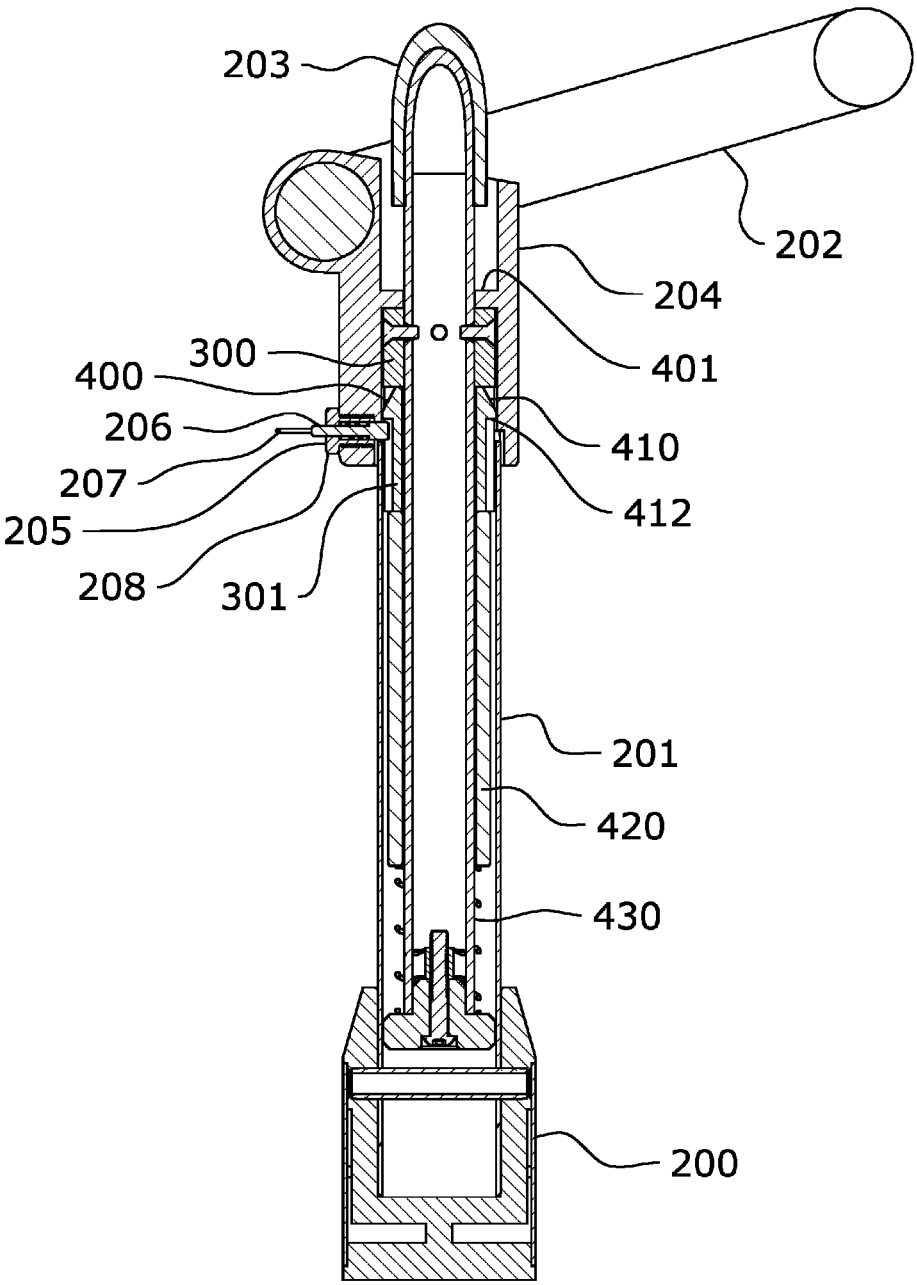
FIG. 13 is a cross sectional view taken along line 13-13 of FIG. 10.
Figure 14:
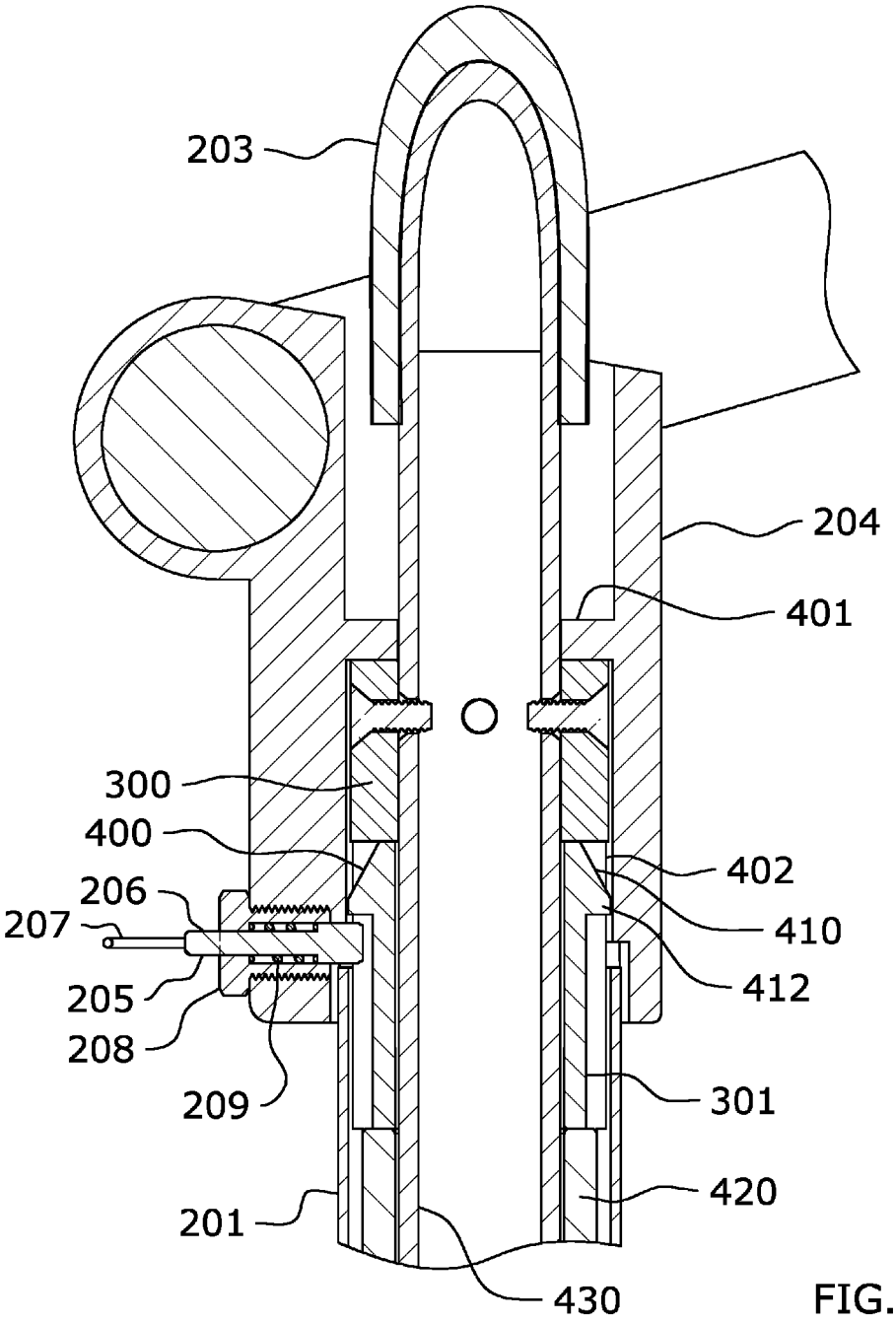
FIG. 14 is a side cutaway view showing the locking device within the collar of the handle structure in the locked position to prevent upwardly movement of the collar and handle structure.
Figure 15:
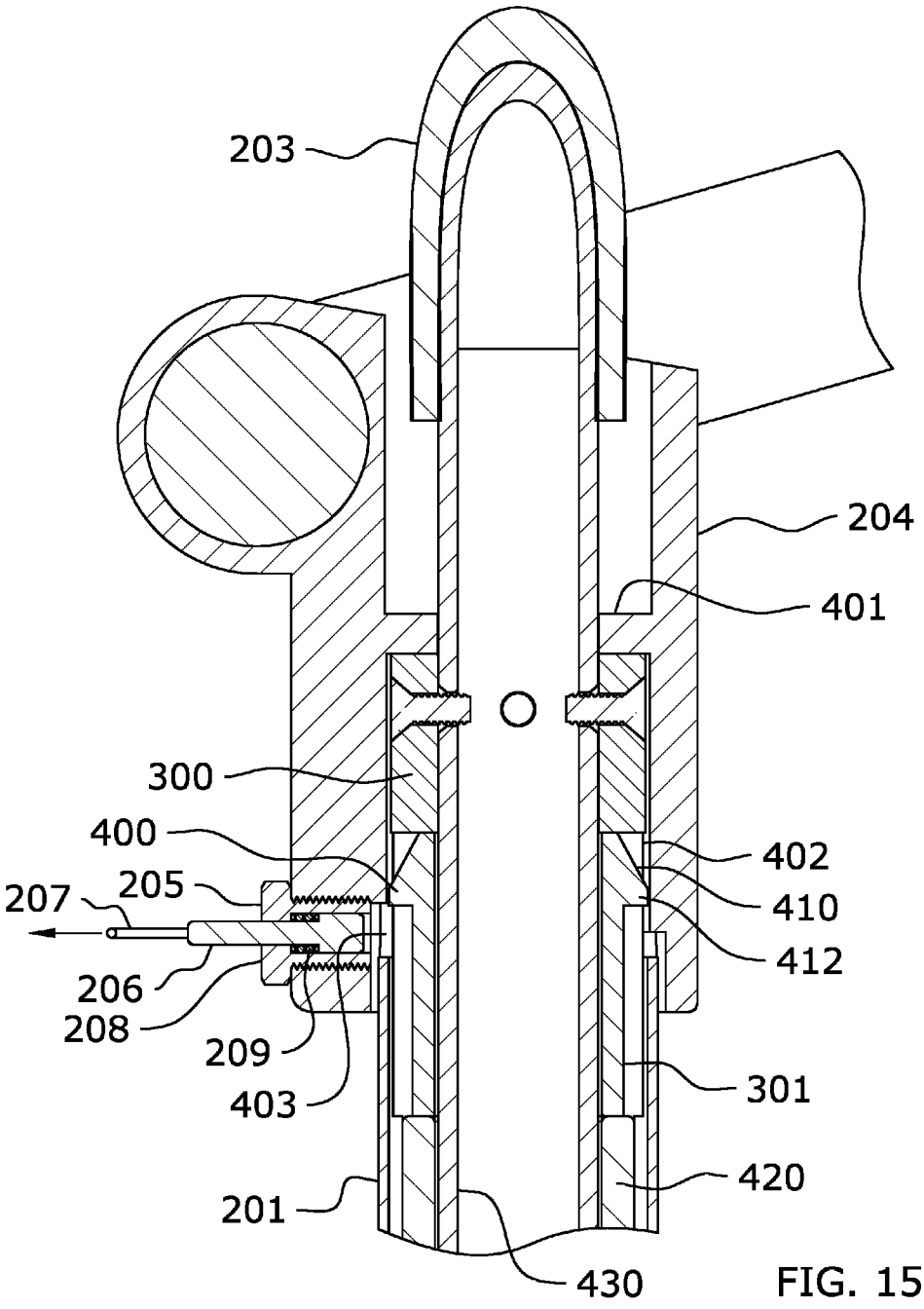
FIG. 15 is a side cutaway view showing the locking device in the unlocked position.
Figure 16:
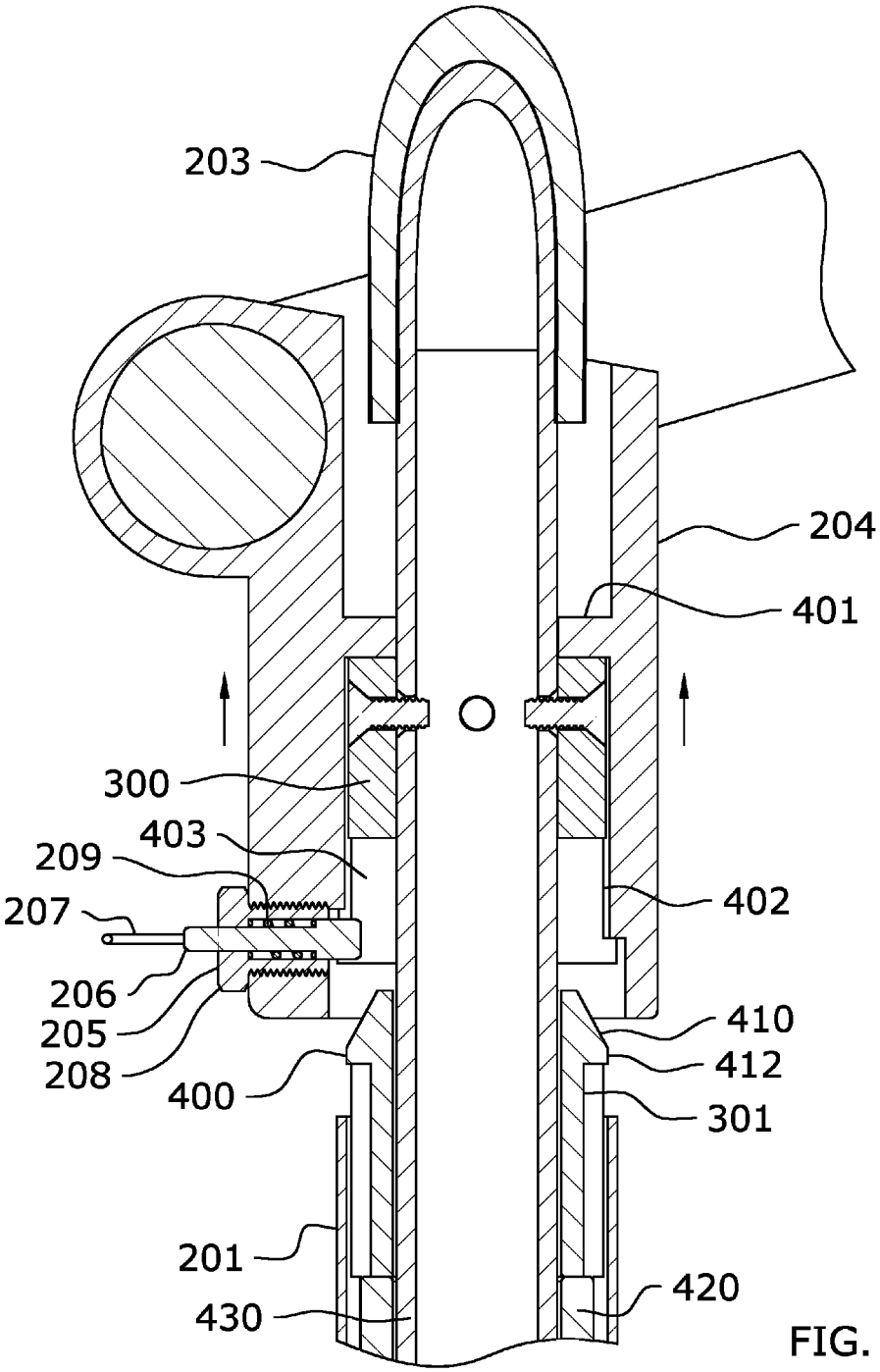
FIG. 16 is a side cutaway view showing the collar and handles lifted upwardly.

In one embodiment, a collar having a lower opening is provided that is connected to the elongated member (directly or indirectly). One or more handles are attached to the collar. The lower opening of the collar is adapted to removably receive the upper end of the tubular base as illustrated in FIGS. 2*b*, 3*b* and 13 of the drawings.

One or more of the adjustable handles are attached to an exercise machine, such as, but not limited to, a Pilates apparatus as illustrated in FIG. 1 of the drawings. The adjustable handles are preferably attached on opposing sides of the exercise machine in one or more pairs so the user may grasp a first adjustable handle with their left hand and a second adjustable handle with their right hand. More than two adjustable handles may be used depending upon the exercise machine and the desired usages of the exercise machine The adjustable handles are illustrates as being attached to the exercise machine at or near the ends of the exercise machine, but the adjustable handles may be attached to the exercise machine between the respective ends.

The exercise machine (e.g. Pilates apparatus) preferably has a frame having a track with a longitudinal axis, a first end and a second end. A carriage movably connected to the track so as to be reciprocated back and forth along a portion of the track. The carriage includes a first end and a second end opposite of the first end. The carriage is adapted to be movable along a portion of the longitudinal axis of the track. One or more bias members (e.g. springs, elastic members) are connected between the frame and the carriage to provide a biasing force to the carriage thereby providing resistance to the exerciser when moving the carriage in a first direction. The exercise machine further includes a first platform connected to or near the first end of the frame and a second platform connected to or near the second end of the frame for the exerciser to position a portion of their body upon during an exercise.

The first adjustable handle and a second adjustable handle are connected to the frame directly or indirectly. The first adjustable handle is on a first side of the frame and the second adjustable handle is on a second side of the frame as illustrated in FIG. 1 of the drawings. The first adjustable handle and the second adjustable handle are each comprised of a base (e.g. tubular base, non-tubular base) and an elongated member that is slidably and rotatably connected to the base. The tubular base has a lower end and an upper end and the tubular base is adapted to be attached to an exercise machine (permanently or removably). The upper end of the tubular base preferably includes an opening though not required if the elongated member slides over the base. The elongated member extends through the opening of the upper end of the tubular base and extends downwardly through at least a portion of the tubular base as illustrated in FIG. 13 of the drawings. A handle extends outwardly from the elongated member at an angle, wherein the handle is directly or indirectly connected to the elongated member. The locking device has a locked state and an unlocked state, wherein the elongated member is movable within the tubular base when the locking device is in the unlocked state and wherein the elongated member is substantially not movable within the tubular base when the locking device is in the locked state.

In another embodiment, a rotational locking assembly is connected between the tubular base and the elongated member. The rotational locking assembly allows for free rotation of the elongated member and/or handle (and corresponding collar) with respect to the tubular base when the elongated member is pulled upwardly from the tubular base. The rotational locking assembly locks the elongated member in one of a plurality of rotational positions with respect to the tubular base when the elongated member is pushed downwardly into the tubular base. In this embodiment, the elongated member is movable in an upward manner within the tubular base when the locking device is in the unlocked state and the elongated member is substantially not movable in an upward manner within the tubular base when the locking device is in the locked state. The rotational locking assembly may be comprised of a lower gear member and an upper gear member that each have teeth that interconnect with corresponding slots within the opposing gear member as illustrated in FIGS. 3*a*, 3*b*, 9 and 13 of the drawings. Various other structures may be utilized to construct the rotational locking assembly.

Unless otherwise defined, all technical and scientific terms used herein have the same meaning as commonly understood by one of ordinary skill in the art to which this invention belongs. Although methods and materials similar to or equivalent to those described herein can be used in the practice or testing of the multiple position locking handle for an exercise machine, suitable methods and materials are described above. All publications, patent applications, patents, and other references mentioned herein are incorporated by reference in their entirety to the extent allowed by applicable law and regulations. The multiple position locking handle for an exercise machine may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a first end, a second end and a pair of parallel rails, wherein the frame has a longitudinal axis;

a carriage movably connected to the pair of parallel rails, the carriage including a first end and a second end opposite of the first end;

wherein the carriage is adapted to be movable along a portion of the longitudinal axis of the frame;

a bias member connected to the carriage, wherein the bias member provides a biasing force to the carriage;

wherein the carriage has an upper surface, wherein the upper surface for the carriage is adapted to allow an exerciser to position a portion of their body upon during an exercise; and a first adjustable handle and a second adjustable handle connected to the frame directly or indirectly, wherein the first adjustable handle is on or near a first side of the frame and the second adjustable handle is on or near a second side of the frame;

wherein the first adjustable handle and the second adjustable handle are each comprised of:

a base having a lower end and an upper end, wherein the base is attached to the exercise machine;

an elongated member rotatably connected to the base;

a first handle extending outwardly from the elongated member, wherein the first handle is adapted for grasping by the exerciser; and an index plunger having a locked state and an unlocked state, wherein the index plunger includes a plunger pin and a spring connected to the plunger pin and a second handle attached to the plunger pin, wherein the second handle is adapted to be grasped and pulled outwardly by a user to position the index plunger into the unlocked state, wherein the spring applies a biasing force to the plunger pin forcing the plunger pin inwardly, wherein the elongated member is rotatable within the base when the index plunger is in the unlocked state and wherein the elongated member is substantially not rotatable within the base when the index plunger is in the locked state.

2. The exercise machine of claim 1, wherein the first handle extends outwardly from the elongated member in a radial manner.

3. The exercise machine of claim 1, wherein the first handle is substantially transverse with respect to the elongated member.

4. The exercise machine of claim 1, wherein the index plunger is connected to the first handle.

5. The exercise machine of claim 4, wherein the index plunger engages the base when in the locked state thereby preventing the elongated member from rotating substantially with respect to the base.

6. The exercise machine of claim 5, wherein the index plunger engages the base when in the locked state thereby preventing the elongated member from moving upwardly substantially with respect to the base.

7. The exercise machine of claim 1, wherein the second handle is comprised of a circular shaped structure.

8. The exercise machine of claim 7, wherein the second handle is comprised of a ring that is pivotally connected to the plunger pin.

9. The exercise machine of claim 7, wherein the index plunger is comprised of a pull-ring index plunger.

10. The exercise machine of claim 1, wherein the second handle is movably connected to the plunger pin.

11. The exercise machine of claim 1, wherein the index plunger is attached to the base.

12. The exercise machine of claim 11, wherein the index plunger selectively engages the elongated member to prevent rotation of the elongated member with respect to the base when the index plunger is in the locked state.

13. The exercise machine of claim 12, wherein the index plunger selectively engages the elongated member to prevent lifting of the elongated member with respect to the base when the index plunger is in the locked state.

14. The exercise machine of claim 11, wherein the plunger pin of the index plunger engages the elongated member to prevent rotation of the elongated member with respect to the base when the index plunger is in the locked state.

15. The exercise machine of claim 1, wherein the base is comprised of a tubular structure with an opening within the upper end, wherein at least a portion of the elongated member extends through the opening into the base.

16. The exercise machine of claim 1, wherein the first handle is positionable into a first lockable handle position and a second lockable handle position.

17. The exercise machine of claim 16, wherein the first lockable handle position is approximately 90 degrees with respect to the second lockable handle position.

18. The exercise machine of claim 16, wherein when the first handle is positioned within the first lockable handle position, the first handle is substantially parallel with respect to the longitudinal axis of the frame.

19. The exercise machine of claim 18, wherein when the first handle is positioned within the second lockable handle position, the first handle is substantially transverse with respect to the longitudinal axis of the frame.

20. The exercise machine of claim 18, wherein when the first handle is positioned within the second lockable handle position, the first handle extends inwardly with respect to the exercise machine.

21. The exercise machine of claim 1, wherein when the index plunger is in the locked state, the plunger pin is retracted inwardly.

22. The exercise machine of claim 21, wherein when the index plunger is in the unlocked state, the plunger pin is extended outwardly.

23. An exercise machine, comprising:

a frame having a first end, a second end and a pair of parallel rails, wherein the frame has a longitudinal axis;

a carriage movably connected to the pair of parallel rails, the carriage including a first end and a second end opposite of the first end;

wherein the carriage is adapted to be movable along a portion of the longitudinal axis of the frame;

a bias member connected to the carriage, wherein the bias member provides a biasing force to the carriage; and a first adjustable handle and a second adjustable handle connected to the frame directly or indirectly, wherein the first adjustable handle is on or near a first side of the frame and the second adjustable handle is on or near a second side of the frame;

wherein the first adjustable handle and the second adjustable handle are each comprised of:

a base having a lower end and an upper end, wherein the base is attached to the exercise machine, and wherein the base is comprised of a tubular structure with an opening within the upper end;

an elongated member rotatably connected to the base, wherein at least a portion of the elongated member extends through the opening into the base;

a first handle extending outwardly from the elongated member, wherein the first handle is adapted for grasping by the exerciser; and an index plunger attached to the base, wherein the index plunger has a locked state and an unlocked state, wherein the index plunger includes a plunger pin and a spring connected to the plunger pin and a second handle attached to the plunger pin, wherein the second handle is adapted to be grasped and pulled outwardly by a user to position the index plunger into the unlocked state, wherein the spring applies a biasing force to the plunger pin forcing the plunger pin inwardly, wherein the elongated member is rotatable within the base when the index plunger is in the unlocked state and wherein the elongated member is substantially not rotatable within the base when the index plunger is in the locked state.

24. The exercise machine of claim 23, wherein the index plunger selectively engages the elongated member to prevent rotation of the elongated member with respect to the base when the index plunger is in the locked state.

25. The exercise machine of claim 24, wherein the index plunger selectively engages the elongated member to prevent lifting of the elongated member with respect to the base when the index plunger is in the locked state.

26. The exercise machine of claim 23, wherein the plunger pin of the index plunger engages the elongated member to prevent rotation of the elongated member with respect to the base when the index plunger is in the locked state.

27. The exercise machine of claim 23, wherein the first handle is positionable into a first lockable handle position and a second lockable handle position.

28. The exercise machine of claim 27, wherein the first lockable handle position is approximately 90 degrees with respect to the second lockable handle position.

29. The exercise machine of claim 27, wherein when the first handle is positioned within the first lockable handle position, the first handle is substantially parallel with respect to the longitudinal axis of the frame.

30. The exercise machine of claim 29, wherein when the first handle is positioned within the second lockable handle position, the first handle is substantially transverse with respect to the longitudinal axis of the frame.

31. The exercise machine of claim 29, wherein when the first handle is positioned within the second lockable handle position, the first handle extends inwardly with respect to the exercise machine.

32. The exercise machine of claim 23, wherein when the index plunger is in the locked state, the plunger pin is retracted inwardly.

33. The exercise machine of claim 32, wherein when the index plunger is in the unlocked state, the plunger pin is extended outwardly.

34. An exercise machine, comprising:

a frame having a first end, a second end and a pair of parallel rails, wherein the frame has a longitudinal axis;

a carriage movably connected to the pair of parallel rails, the carriage including a first end and a second end opposite of the first end;

wherein the carriage is adapted to be movable along a portion of the longitudinal axis of the frame;

a bias member connected to the carriage, wherein the bias member provides a biasing force to the carriage; and a first adjustable handle and a second adjustable handle connected to the frame directly or indirectly, wherein the first adjustable handle is on or near a first side of the frame and the second adjustable handle is on or near a second side of the frame;

wherein the first adjustable handle and the second adjustable handle are each comprised of:

a base having a lower end and an upper end, wherein the base is attached to the exercise machine, and wherein the base is comprised of a tubular structure with an opening within the upper end;

an elongated member rotatably connected to the base, wherein at least a portion of the elongated member extends through the opening into the base;

a first handle extending outwardly from the elongated member, wherein the first handle is adapted for grasping by the exerciser, and wherein the first handle is positionable into a first lockable handle position and a second lockable handle position; and an index plunger attached to the base, wherein the index plunger has a locked state and an unlocked state, wherein the index plunger includes a plunger pin and a spring connected to the plunger pin and a second handle attached to the plunger pin, wherein the second handle is adapted to be grasped and pulled outwardly by a user to position the index plunger into the unlocked state, wherein the spring applies a biasing force to the plunger pin forcing the plunger pin inwardly, wherein the elongated member is rotatable within the base when the index plunger is in the unlocked state and wherein the elongated member is substantially not rotatable within the base when the index plunger is in the locked state, wherein the plunger pin is retracted inwardly when the index plunger is in the locked state and wherein the plunger pin is extended outwardly when the index plunger is in the unlocked state.

35. The exercise machine of claim 34, wherein the index plunger selectively engages the elongated member to prevent rotation of the elongated member with respect to the base when the index plunger is in the locked state.

36. The exercise machine of claim 35, wherein the index plunger selectively engages the elongated member to prevent lifting of the elongated member with respect to the base when the index plunger is in the locked state.

37. The exercise machine of claim 34, wherein the plunger pin of the index plunger engages the elongated member to prevent rotation of the elongated member with respect to the base when the index plunger is in the locked state.

38. The exercise machine of claim 34, wherein the first lockable handle position is approximately 90 degrees with respect to the second lockable handle position.

39. The exercise machine of claim 34, wherein when the first handle is positioned within the first lockable handle position, the first handle is substantially parallel with respect to the longitudinal axis of the frame.

40. The exercise machine of claim 39, wherein when the first handle is positioned within the second lockable handle position, the first handle is substantially transverse with respect to the longitudinal axis of the frame.

41. The exercise machine of claim 39, wherein when the first handle is positioned within the second lockable handle position, the first handle extends inwardly with respect to the exercise machine.

* * * * *